US007783218B2

(12) United States Patent
Maeda et al.

(10) Patent No.: US 7,783,218 B2
(45) Date of Patent: Aug. 24, 2010

(54) FIXING APPARATUS, IMAGE FORMING APPARATUS, AND METHOD FOR CONTROLLING FIXING APPARATUS

(75) Inventors: Tomohiro Maeda, Yao (JP); Toshiaki Kagawa, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 722 days.

(21) Appl. No.: 11/683,455

(22) Filed: Mar. 8, 2007

(65) Prior Publication Data

US 2007/0212093 A1 Sep. 13, 2007

(30) Foreign Application Priority Data

Mar. 10, 2006 (JP) ..... 2006-066668

(51) Int. Cl.
*G03G 15/20* (2006.01)

(52) U.S. Cl. ..... 399/69; 399/328

(58) Field of Classification Search ..... 399/69, 399/67, 70, 328–330; 219/216, 469–471
See application file for complete search history.

(56) References Cited

U.S. PATENT DOCUMENTS

| | | | | |
|---|---|---|---|---|
| 6,351,619 | B1 * | 2/2002 | Yamada | 399/70 |
| 6,411,785 | B1 * | 6/2002 | Ogawahara et al. | 399/69 |
| 2005/0117942 | A1 * | 6/2005 | Ishii et al. | 399/328 |
| 2005/0141936 | A1 | 6/2005 | Kawashima | |
| 2006/0245796 | A1 * | 11/2006 | Wu et al. | 399/328 |
| 2008/0044210 | A1 | 2/2008 | Kawashima | |
| 2008/0080911 | A1 | 4/2008 | Ishii et al. | |

FOREIGN PATENT DOCUMENTS

| | | |
|---|---|---|
| JP | 3632724 | 1/1999 |
| JP | 2000-305393 A | 11/2000 |
| JP | 2002-229376 A | 8/2002 |
| JP | 2002-372892 A | 12/2002 |
| JP | 2003-280419 A | 10/2003 |
| JP | 2005-164691 A | 6/2005 |
| JP | 2005-241890 A | 9/2005 |
| JP | 2005-266395 | 9/2005 |
| JP | 2005-292714 | 10/2005 |

* cited by examiner

*Primary Examiner*—David P Porta
*Assistant Examiner*—Milton Gonzalez
(74) *Attorney, Agent, or Firm*—Renner, Otto, Boiselle & Sklar, LLP

(57) ABSTRACT

For start of rotation of a fixing roller that is not currently being rotated, a control device causes a halogen lamp to heat an endless belt until a thermistor detects that a surface temperature of the endless belt has reached a first target temperature set at a temperature at which the endless belt is softened and is restored to its normal shape, from a deformed shape that the endless belt had while it was not rotated, to such an extent that the endless belt will never cause any rotation trouble during the rotation. This prevents the rotation trouble of the belt in a fixing apparatus in which a fixing member is heated by bringing the thus heated belt into contact with the fixing member.

6 Claims, 12 Drawing Sheets

FIXING APPARATUS, IMAGE FORMING APPARATUS, AND METHOD FOR CONTROLLING FIXING APPARATUS

This Nonprovisional application claims priority under 35 U.S.C. §119(a) on Patent Application No. 2006/066668 filed in Japan on Mar. 10, 2006, the entire contents of which are hereby incorporated by reference.

FIELD OF THE INVENTION

The present invention relates to (i) a fixing apparatus provided in an electrophotographic image forming apparatus, (ii) a method for controlling the fixing apparatus, (iii) a control program, and (iv) a recording medium storing the control program.

BACKGROUND OF THE INVENTION

As a conventional fixing apparatus provided in an electrophotographic image forming apparatus, there is a roller pair type fixing apparatus made up of a fixing roller and a pressure roller.

An example of such a fixing roller is a fixing roller in which a halogen lamp is provided as a heating source inside a hollow shaft that is made of a metal such as aluminum and that has a surface on which an elastic layer is provided. Generally, a temperature of a surface of the fixing roller of this type is kept at a constant temperature as a result of ON/OFF control over the halogen lamp. The ON/OFF control is carried out by a temperature control circuit in accordance with a signal supplied from a temperature sensor provided on the surface of the fixing roller.

Meanwhile, an example of such a pressure roller is a pressure roller in which a heat resistant elastic layer such as a silicone rubber is provided as a coating layer on a shaft. When the pressure roller and the fixing roller are pressed against each other, a predetermined nip region is formed as a result of elastic deformation of the elastic layers. In the roller pair type fixing apparatus, a sheet to which an unfixed toner image has been transferred passes through the nip region, with the result that the toner image is melted by the heat and is fixed to the sheet.

However, such a conventional and general roller pair type fixing apparatus suffers from the following problem. That is, in cases where a plurality of sheets continuously pass therethrough at a fast sheet passing speed, the temperature of the surface of the fixing roller is extremely decreased. This makes it difficult to keep the temperature of the surface of the fixing roller at a constant temperature. A reason of this is that: the heat generated from the inside of the shaft is conducted to the toner image via the elastic layer (e.g., silicone rubber), which has a bad heat conductivity, and it therefore takes a quite a long time that the heat is conducted from (i) the heating source provided inside the shaft to (ii) the surface of the fixing roller.

In order to solve such a problem, an external heating type fixing apparatus has been proposed. Such an external heating type fixing apparatus is disclosed in, e.g., Patent Citation 1 (Japanese Unexamined Patent Publication Tokukai 2005-266395 (published on Sep. 29, 2005)) and Patent Citation 2 (Japanese Unexamined Patent Publication Tokukai 2005-292714 (published on Oct. 20, 2005)). In the fixing apparatus disclosed in each of Patent Citations 1 and 2, an endless belt (external heating belt) is set around a plurality of belt supporting rollers (external heating rollers). The endless belt is heated and is brought into contact with a fixing roller, thereby heating a surface of the fixing roller.

In the meanwhile, Patent Citation 3 (Japanese Patent Publication Tokkyo 3632724 (publication date of Laid-Open stage is Jan. 29, 1999)) discloses a fixing apparatus including a releasing/contacting mechanism for bringing an external heating member out of contact with a fixing roller (heating roller). This prevents the fixing roller from leaving a trace on the external heating member as a result of being pressed against the external heating member. Further, Patent Citation 3 describes that the external heating member is pressed against the fixing roller when the external heating member is in a warm-up state or stand-by mode and reaches a reference temperature equal to or higher than a toner softening point. This prevents the surface of the fixing roller from being scratched by toner transferred from the fixing roller to the external heating member and adhered to and accumulated in the external heating member.

However, each technique of Patent Citations 1 and 2 suffers from the following problem. Consider a case where the endless belt is left for a long time with no rotation of the fixing roller. In this case, the endless belt will remain in a deformed shape in which the endless belt has been while the endless belt is left. For example, in cases where the endless belt is set around two belt supporting rollers, the endless belt will remain in an elliptic shape (keeps on being bent). The endless belt thus remaining in such a deformed shape causes a trouble in rotation, when the fixing roller is started to rotate. A specific example of the trouble is slip or the like. Especially, in cases where the endless belt is left at a high temperature for a long time and is thereafter cooled down to a room temperature, the endless belt will be highly likely to remain in such a deformed shape.

The following explains this problem more in detail. In cases where an external heating device is constituted by an endless belt held by a plurality of belt supporting rollers as is the case with Patent Citation 1 and 2, each of the belt supporting rollers normally has a small diameter so as to have a heat capacity as small as possible. Thus, the endless belt is held by such belt supporting rollers each having a small curvature radius. In cases where the endless belt is left for a long time with no rotation of the belt supporting rollers, the endless belt will remain in a deformed shape that the endless belt has while the endless belt is left. Usually, for attainment of the small heat capacity, the number of the belt supporting rollers is two, which is minimally required number. The endless belt thus set around the two belt supporting rollers is tensed between the two belt supporting rollers, so that the endless belt will remain in an elliptic shape especially in cases where the endless belt is left for a long time with no rotation of the belt supporting rollers.

When starting to rotate the endless belt thus remaining in such a deformed shape, a rotation trouble of the belt such as slip occurs due to the deformed shape. In addition, such a rotation trouble as slip of the belt is especially likely to occur in cases where a material having a small friction resistance, such as a PFA tube, PTFE, or PFA coating, is used for respective surfaces of the fixing member and the belt. Such a material having a small friction resistance is frequently used therefor in view of a releasing property.

When the rotation trouble of the endless belt occurs, the surface of the fixing roller and the surface of the endless belt are rubbed with each other, with the result that the surface of the fixing roller is scratched by toner accumulated, due to offset or the like, on either the surface of the fixing roller or the surface of the endless belt.

In addition, in cases where there is a restriction in a distance between the respective axes of the belt supporting rollers, slip shaft bearings are likely to be used as supporting members respectively provided in the ends of each of the belt supporting rollers, instead of ball bearings. Further, for simplicity of mechanism and space saving, the fixing apparatus is possibly arranged such that: the external heating device is not provided with a driving source, and the endless belt is rotated according to the rotation of the fixing roller. In other words, the fixing apparatus is possibly arranged as follows. A rotation driving source is provided in the fixing roller, and the endless belt is brought into contact with the surface of the fixing roller such that the endless belt and the belt supporting rollers are rotated due to friction with the fixing roller. In these cases, the aforementioned rotation trouble of the endless belt especially occurs with ease.

Meanwhile, in Patent Citation 3, during the warm-up or the standby mode, the external heating member is brought out of contact with the fixing roller. With this, the external heating member is not pressed against the fixing roller, and no trace of the fixing roller is therefore left on the external heating member. However, even though the external heating member is brought out of contact with the fixing member as such, it is impossible to prevent the endless belt from remaining in the deformed shape after being left for a long time, in cases where the external heating device in which the endless belt is set around the belt supporting rollers is used.

Further, in Patent Citation 3, during the warm-up or the standby mode, the external heating member is pressed against the fixing roller when the external heating member reaches the reference temperature equal to or higher than the toner softening point. This softens the toner adhered to the surface of external heating member. Therefore, even though the external heating member is pressed against the fixing roller, the fixing roller is never scratched by the toner adhered to the external heating member. Patent Citation 3 thus makes it possible to soften the toner adhered to the external heating member, but does not take into consideration the external heating device in which the endless belt is set around the plurality of belt supporting rollers. Therefore, Patent Citation 3 possibly cannot prevent the rotation trouble occurring due to the deformed shape in which the endless belt remains.

Further, the external heating device generally has a small heat capacity such that the temperature thereof is raised quickly. This makes it difficult to carry out precise temperature control when the rotation trouble occurs. For example, in cases where temperature control is started when a temperature sensor or the like detects that the temperature of the external heating device reaches the set temperature, the temperature thereof becomes very high due to overshoot. This is problematic. When the external heating device has too a high temperature, the heat causes problems such as (i) breakage of the endless belt or the coating layer of the fixing roller and (ii) twisting of the belt supporting rollers.

SUMMARY OF THE INVENTION

The present invention is made in view of the foregoing conventional problems, and its object is to prevent the aforementioned belt rotation trouble occurring in a fixing apparatus in which a fixing member is heated by a heated belt pressed against the heating member.

To achieve the object, a fixing apparatus of the present invention includes a fixing member; a pressure member; an external heating device, in which a belt set around a plurality of supporting rollers in contact with a peripheral surface of the fixing member is heated by a first heating section so as to heat the fixing member and the belt is rotated according to rotation of the fixing member; the fixing member and the pressure member sandwiching and transporting a recording material, so that an unfixed image formed on the recording material is fixed onto the recording material by heating from the fixing member, the fixing apparatus further including: a first temperature detecting section for detecting a surface temperature of the belt; a rotation driving section for driving to rotate the fixing member; and a control section for causing the first heating section to heat the belt for start of rotation of the fixing member, and causing the rotation driving section to rotate the fixing member when the belt reaches a first target temperature at which the belt is softened.

To achieve the object, a method of the present invention for controlling a fixing apparatus including a fixing member; a pressure member; an external heating device, in which a belt set around a plurality of supporting rollers in contact with a peripheral surface of the fixing member is heated by a first heating section so as to heat the fixing member and the belt is rotated according to rotation of the fixing member; the fixing member and the pressure member sandwiching and transporting a recording material, so that an unfixed image formed on the recording material is fixed onto the recording material by heating from the fixing member, the method including: a heating step of heating the belt by the first heating section; a temperature detecting step of detecting a surface temperature of the belt; and a rotation starting step of starting rotation of the fixing apparatus when the temperature detected in the temperature detecting step reaches a first target temperature at which the belt is softened.

According to the above fixing apparatus and the control method therefor, the first heating section is started to heat the belt first, for the start of the rotation of the fixing member that is not currently being rotated. Then, when the first temperature detecting section detects that the surface temperature of the belt has reached the first target temperature at which the belt is softened by heating, the rotation driving section is caused to start rotating the fixing member. In this way, the belt is softened and then is started to be rotated, so that it is possible to prevent a rotation trouble such as slip from occurring due to a deformed shape (bent shape) that the belt had while the belt was not rotated. With this, the fixing member is rotated according to the rotation of the fixing member in an appropriate manner.

An image forming apparatus of the present invention includes the above fixing apparatus, so that it is possible to prevent the rotation trouble of the belt provided in the external heating device of the fixing apparatus.

Note that the control section of the fixing apparatus may be realized by a computer. In this case, the present invention encompasses (i) a control program for causing the computer to function as the control section, and (ii) a computer-readable recording medium storing the control program.

Additional objects, features, and strengths of the present invention will be made clear by the description below. Further, the advantages of the present invention will be evident from the following explanation in reference to the drawings.

Figure 12:
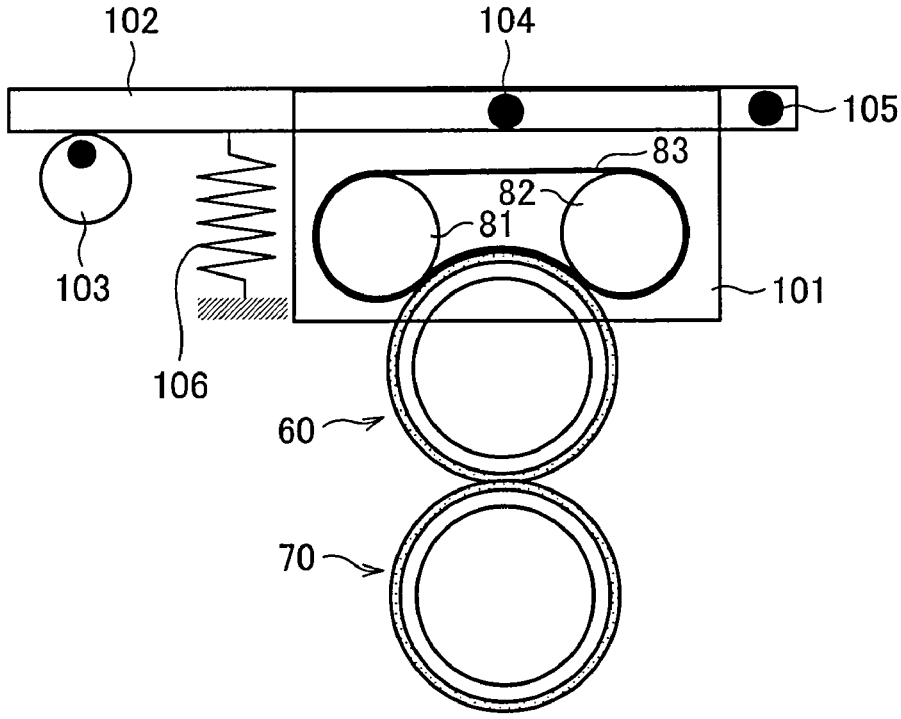
Figure 12:
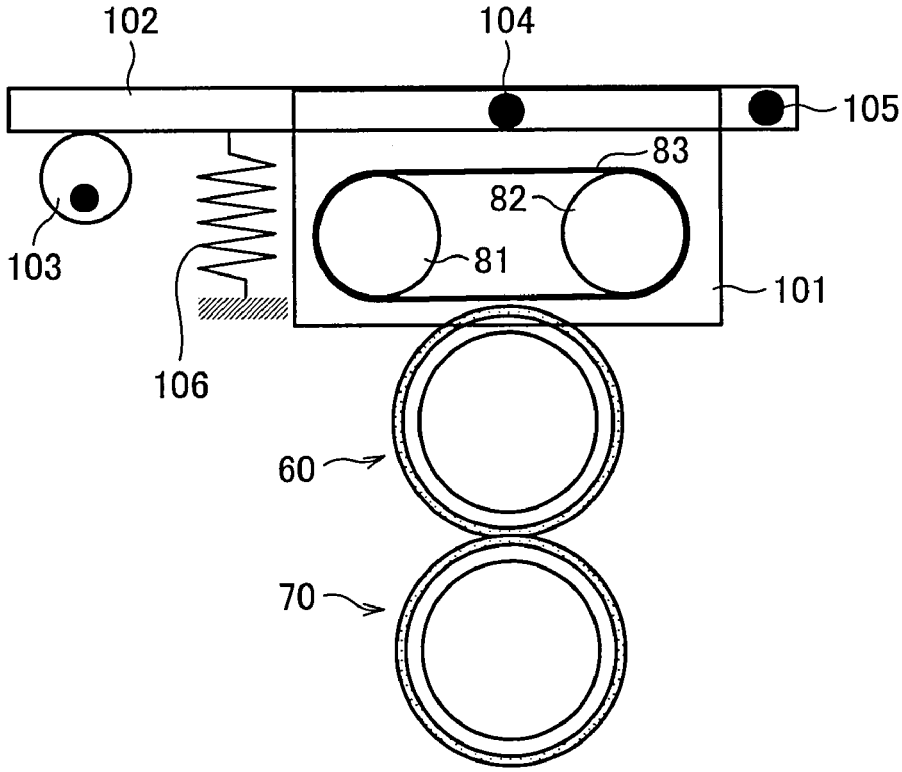

Each of FIG. 12(*a*) and FIG. 12(*b*) is an explanatory diagram illustrating an example of a structure, which the fixing apparatus according to the embodiment of the present invention has and in which a releasing/contacting mechanism for separating the external heating device from the fixing roller and bringing the eternal heating device into contact with the fixing roller.

DESCRIPTION OF THE EMBODIMENTS

Figure 2:
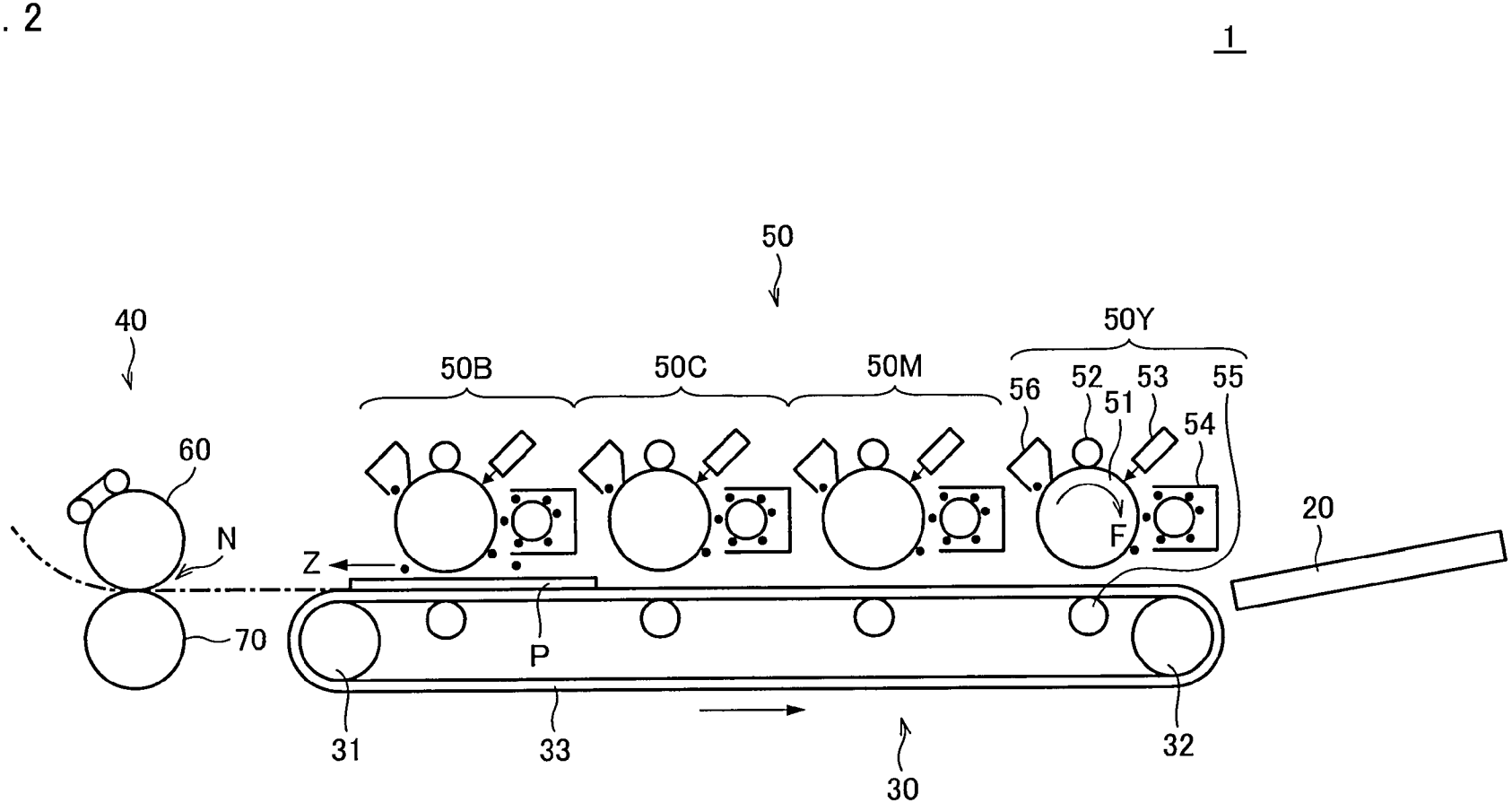
FIG. 2 is a diagram schematically illustrating an internal structure of an image forming apparatus including the fixing apparatus shown in FIG. 1.

One embodiment of the present invention will be described below. Firstly explained is an image forming apparatus 1 in which a fixing apparatus of the present embodiment is provided, with reference to FIG. 2. FIG. 2 is a diagram schematically illustrating an internal structure of the image forming apparatus 1. The image forming apparatus 1 is a dry type electrophotographic color image forming apparatus, and is a printer for forming either a color image or a monochrome image on a sheet (recording material) P in accordance with either (i) image data transmitted from each of terminal devices connected to the image forming apparatus via a network, or (ii) image data read out by a scanner.

The image forming apparatus 1, the dry type electrophotographic color printer, is a 4-drum tandem type color printer and includes a visible image transferring section 50, a sheet transporting section 30, a fixing apparatus 40, and a sheet supply tray 20.

The visible image transferring section 50 is made up of a yellow image transferring section 50Y, a magenta image transferring section 50M, and a cyan image transferring section 50C, and a black image transferring section 50B. Specifically, the yellow image transferring section 50Y, the magenta image transferring section 50M, and the cyan image transferring section 50C, and the black image transferring section 50B are provided in this order between the sheet supply tray 20 and the fixing apparatus 40.

These transferring sections 50Y, 50M, 50C, and 50B have substantially the same structure, and respectively transfer a yellow image, a magenta image, a cyan image, and a black image onto the sheet P.

The transferring sections 50Y, 50M, 50C, and 50B include photosensitive drums 51, respectively. Provided around each of the photosensitive drums 51 are a charger 52, an LSU 53, a developing unit 54, a transferring roller 55, and a cleaning device 56. The charger 52, the LSU 53, the developing unit 54, the transferring roller 55, and the cleaning device 56 are disposed along a rotation direction (F direction in FIG. 2) of the photosensitive drum 51.

Each of the photosensitive drums 51 of the transferring sections 50Y, 50M, 50C, and 50B is a transferring roller having a drum-like shape and having a surface provided with a photosensitive material, and is driven to rotate in the F direction indicated by an arrow. The charger 52 evenly (uniformly) charges the surface of the photosensitive drum 51. As the charger 52, a charger type corona discharger can be used, for example.

The LSUs (laser beam scanner units) 53 of the transferring sections 50Y, 50M, 50C, and 50B receive pixel signals corresponding a yellow component, a magenta component, a cyan component, and a black component in the image data, respectively. In accordance with the pixel signals, the LSUs 53 expose the charged photosensitive drums 51 so as to generate electrostatic latent images, respectively.

The developing units 54 of the transferring sections 50Y, 50M, 50C, and 50B have yellow toner, magenta toner, cyan toner, black toner, respectively. The developing units 54 have a function of generating toner images (visualized images) by developing, with the use of the toners, the electrostatic latent images generated on the photosensitive drums 51, respectively.

Each of the transferring rollers 55 of the transferring sections 50Y, 50M, 50C, and 50B is fed with a bias voltage whose polarity is opposite to that of each of the toners. Each of the transferring rollers 55 applies such a bias voltage to the sheet P, with the result that each of the toner images formed on the photosensitive drums 51 is transferred to the sheet P. Each of the cleaning devices 56 of the transferring sections 50Y, 50M, 50C, and 50B removes toner remained on each of the photosensitive drums after the image transferring onto the sheet P. The image transferring is carried out four times for the four colors.

The sheet transporting section 30 is made up of a driving roller 31, an idling roller 32, and a transporting belt 33, and transports the sheet P such that the toner images are sequentially formed on the sheet P by the transferring sections 50Y, 50M, 50C, and 50B.

The transporting belt 33 is set around the driving roller 31 and the idling roller 32. The driving roller 31 is controlled to rotate at a predetermined rotation speed, thereby rotating the transporting belt 33.

The transporting belt 33 is a belt set around the driving roller 31 and the idling roller 32 so as to be in contact with each of the photosensitive drums 51 of the transferring sections 50Y, 50M, 50C, and 50B. The transporting belt 33 is rubbed with the rollers 31 and 32 and therefore rotates in the Z direction indicated by an arrow. The sheet P supplied from the sheet supply tray 20 is attached to the transporting belt 33 due to electrostatic, and is transported to the transferring sections 50Y, 50M, 50C, and 50B in this order.

The sheet P, onto which the toner images have been respectively transferred by the transferring sections 50Y, 50M, 50C, and 50B, is separated from the transporting belt 33 by the curvature of the driving roller 31 and is transported to the fixing apparatus 40 (as indicated by a chain line of FIG. 2). Note that the toner images transferred from the transferring sections 50Y, 50M, 50C, and 50B to the sheet P have not been fixed thereto yet.

The fixing apparatus 40 uses heat so as to fix, to the sheet P, the toner images adhered to but unfixed to the sheet P. Specifically, the fixing apparatus 40 is provided with a fixing roller 60 and a pressure roller 70. Formed between the fixing roller 60 and the pressure roller 70 is a fixing nip section N, to which the sheet P transported from the visible image transferring section 50 is supplied. The fixing roller 60 and the pressure roller 70 sandwich and transfer the sheet P, with the result that the toner images (unfixed images) on the sheet P are fixed to the sheet P due to heat of the peripheral surface of the fixing roller 60. That is, the toners are melted and fixed to the sheet, and the sheet shines after the fixation.

The sheet P, which has been through the toner image fixing process carried out by the fixing apparatus 40, is ejected onto a catch tray (not shown) provided in an exterior of the image forming apparatus 1, thus ending the image forming process. Note that a detailed structure of the fixing apparatus 40 will be fully described later.

Further, the image forming apparatus 1 can operate at a color mode (multicolor mode) and a monochrome mode (plain color mode). In the color mode, a color image (multicolor image) is formed as a result of image transferring carried out by the transferring sections 50Y, 50M, 50C, and 50B with respect to the sheet P. In the monochrome mode, a monochrome image is formed as a result of image transferring carried out by the black image transferring section 50B with respect to the sheet P. Specifically speaking, the image forming apparatus 1 has a control section (control purpose integrated circuit substrate or computer; not shown), and the control section selects either one of the color mode and the monochrome mode in accordance with an instruction sent from a user and controls the transferring sections 50Y, 50M, 50C, and 50B such that the transferring sections 50Y, 50M, 50C, and 50B carry out image forming in accordance with the selected mode.

Figure 1:
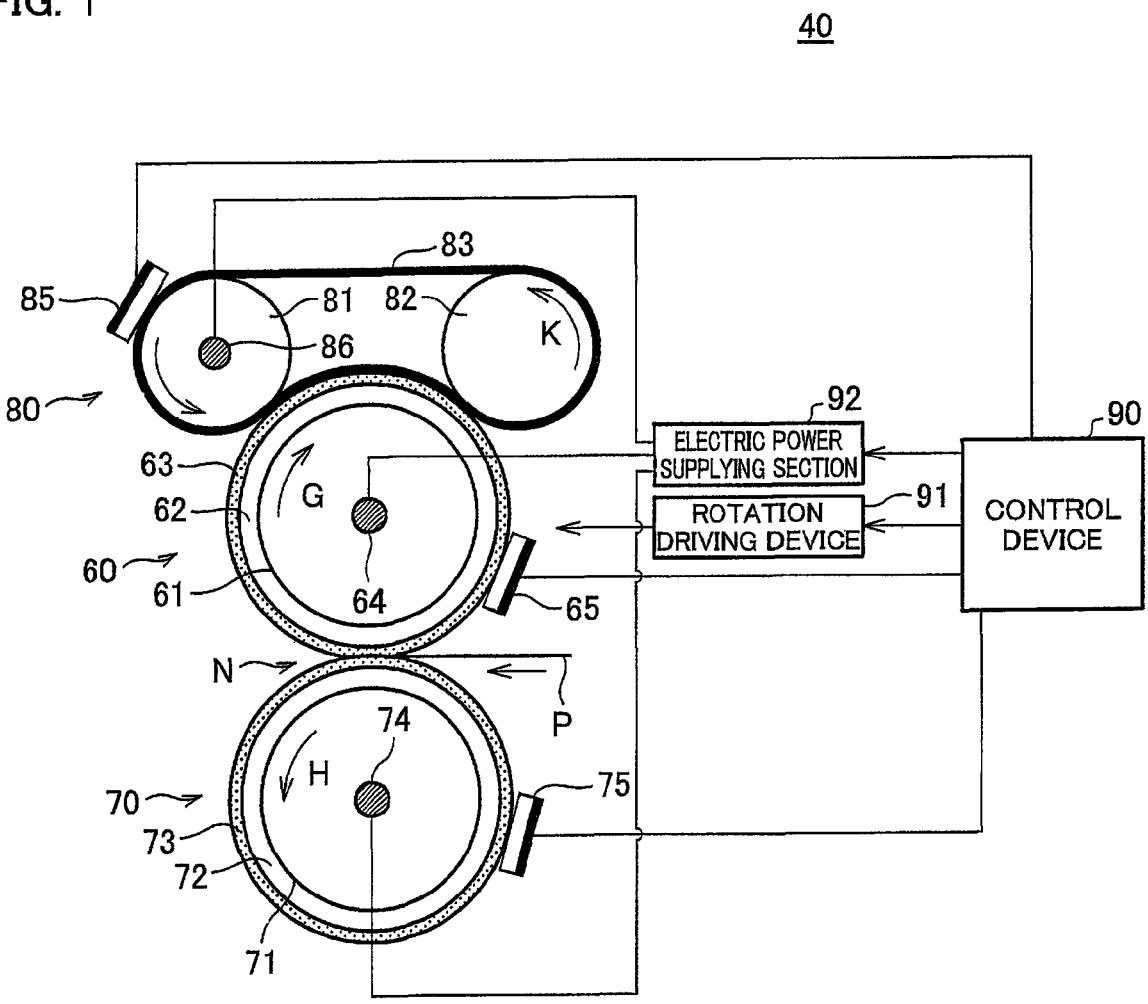
FIG. 1 is a diagram schematically illustrating an overview of a structure of a fixing apparatus according to one embodiment of the present invention.

The following specifically explains the fixing apparatus 40. FIG. 1 is a diagram schematically illustrating an overview of the structure of the fixing apparatus 40. In addition to the aforementioned fixing roller (fixing member) 60 and the aforementioned pressure roller (pressure member) 70, the fixing apparatus 40 includes an external heating device 80, a control device (control section) 90, and a rotation driving device (rotation driving section) 91.

The rotation driving device 91 drives and rotates the fixing roller 60, and is made up of, e.g., a motor (not shown), a driving gear (not shown), and the like. Note that an operation of the rotation driving device 91 is controlled by the control device 90.

The fixing roller 60 is a roller rotating in the G direction shown in FIG. 1, and is made up of (i) a shaft 61 made of a metal and having a hollow cylindrical shape, (ii) an elastic layer 62 covering the external peripheral surface of the shaft 61, and (iii) a releasing layer 63 formed so as to cover the elastic layer 62.

The shaft 61 has an external diameter of 46 mm, is made of aluminum, and has a cylindrical shape. However, the material of which the shaft 61 is made is not limited to aluminum, but may be iron, stainless steel, or the like. The elastic layer 62 has a thickness of 2 mm, and is made of a heat resistant silicone rubber. The releasing layer 63 is made up of a PFA tube having a thickness of approximately 30 μm. The wording "PFA" refers to a copolymer of tetrafluoroethylene and perfluoroalkylvinylether. Note that the releasing layer 63 may be made of any material that is excellent in heat resistance and durability and that securely releases toner from the fixing roller 60. Therefore, apart from PFA, a fluorine-based material such as PTFE (polytetrafluoroethylene) can be used for the releasing layer 63. The fixing roller 60 thus arranged has an external diameter of 50 mm, and has a surface hardness of 68 degree (ASKER-C hardness).

A thermistor (second temperature sensor, second temperature detecting section) 65 is provided in contact with the peripheral surface of the fixing roller 60 so as to detect a temperature of the peripheral surface. Provided inside the shaft 61 is a halogen lamp (second heat source device, second heating section) 64 for carrying out heat radiation in response to supply of electric power. The halogen lamp 64 serves as a heat source for the fixing roller 60. When electric power is supplied to the halogen lamp 64, the halogen lamp 64 heats the inside of the fixing roller 60. In the present embodiment, one halogen lamp is provided therein; however, the present invention is not limited to this. For example, two lamps different from each other in calorific power are provided so as to form an optimum temperature distribution according to a sheet size, and are used such that one is used for a small size sheet and the other is used for a large size sheet. Further, in the present embodiment, the thermistor 65 is provided in contact with the fixing roller 60 so as to meet the central portion thereof in the longitudinal direction of the fixing roller 60; however, the present invention is not limited to this. The thermistor 65 may be provided in contact with the fixing roller 60 so as to meet an end portion (non-sheet-passing region) thereof in the longitudinal direction. Further, thermistors 65 may be provided respectively in both the central portion and the end portion in cases where two halogen lamps are provided and calorific powers are therefore different between the central portion and the end portion.

The pressure roller 70 is a roller rotating in the H direction shown in FIG. 1, and is made up of (i) a shaft 71 made of a metal and having a hollow cylindrical shape, (ii) an elastic layer 72 covering the external peripheral surface of the shaft 71, and (iii) a releasing layer 73 formed so as to cover the elastic layer 72.

The shaft 71 has an external diameter of 46 mm and is made of aluminum. However, the material of which the shaft 71 is made is not limited to aluminum, but may be iron, stainless steel, or the like. The elastic layer 72 has a thickness of 2 mm, and is made of a heat resistant silicone rubber. The releasing layer 73 is made up of a PFA tube having a thickness of approximately 30 μm. Note that the releasing layer 73 may be made of any material that is excellent in heat resistance and durability and that securely releases toner from the pressure roller 70. Therefore, apart from PFA, a fluorine-based material such as PTFE can be used for the releasing layer 73. The pressure roller 70 thus arranged has an external diameter of 50 mm, and has a surface hardness of 75 degree (ASKER-C hardness).

The pressure roller 70 is pressed against the fixing roller 60 by a resilient member (spring) that is not shown in FIG. 1. This allows formation of the fixing nip section N between the peripheral surface of the fixing roller 60 and the peripheral surface of the pressure roller 70. Note that the pressure roller 70 is rotated according to the rotation of the fixing roller 60 in the present embodiment; however, the present invention is not limited to this. The pressure roller 70 may be driven to be rotated by a rotation driving section different from the fixing roller 60.

A thermistor (third temperature detecting section) 75 is provided in contact with the peripheral surface of the pressure roller 70 so as to detect a temperature of the peripheral surface. Provided inside the shaft 71 is a halogen lamp (third heating section) 74 for carrying out heat radiation in response to supply of electric power. The halogen lamp 74 serves as a heat source for the pressure roller 70. When electric power is supplied to the halogen lamp 74, the halogen lamp 74 heats the inside of the pressure roller 70.

In the present embodiment, the rubber hardness (75 degree) of the pressure roller 70 is harder than the rubber hardness (68 degree) of the fixing roller 60 such that the fixing nip section N formed between the pressure roller 70 and the fixing roller 60 has a reverse nip shape. The wording "reverse nip shape" refers to such a shape that the shape of the pressure roller 70 is hardly changed but the fixing roller 60 is recessed slightly. The fixing nip section N thus obtained has a nip width of 8.5 mm.

Explained here is a reason why the fixing nip section N formed between the pressure roller 70 and the fixing roller 60 is caused to have the reverse nip shape. When passing through the fixing nip section N having such a reverse nip shape, the sheet P goes out therefrom in the direction along the peripheral surface of the pressure roller 70, with the result that the sheet P is naturally detached from the rollers with ease. In other words, the sheet P is detached therefrom with its own flexibility, i.e., with no assistance from any forceful detachment assisting means such as a detaching nail.

If the surface hardness of the pressure roller 70 is softer than the surface hardness of the fixing roller 60, the fixing nip section N formed between the fixing roller 60 and the pressure roller 70 has such a shape that the shape of the fixing roller 60 is hardly changed but the pressure roller 70 is slightly recessed. As a result, when passing through the fixing nip section N, the sheet P goes out therefrom in the direction along the peripheral surface of the fixing roller 60. This makes it difficult for the sheet P to be detached naturally from the rollers.

The external heating device 80 is made up of a first supporting roller (supporting roller) 81, a second supporting roller (supporting roller) 82, and an endless belt (external heating belt, belt) 83. The endless belt 83 is set around the supporting rollers 81 and 82 such that the internal surface of the endless belt 83 makes contact with the respective peripheral surfaces of the supporting rollers 81 and 82. The endless belt 83 is rotated (revolved) according to rotation of the fixing roller 60, so that the supporting rollers 81 and 82 are rotated in the direction (K direction shown in FIG. 1) reverse to the rotation direction of the fixing roller 60. In other words, when the control device 90 controls the rotation driving section of the fixing roller 60 for the purpose of rotating the fixing roller 60, the endless belt 83 is moved, according to the rotation of the fixing roller 60, due to friction force in a contact portion of the endless belt 83 and the fixing roller 60, with the result that the supporting rollers 81 and 82 and the endless belt 83 are rotated.

The endless belt 83 is a belt member in which a releasing layer made of PTFE and having a thickness of 10 μm is formed on a base material having a thickness of 90 μm and made of polyimide. The endless belt 83 has an internal diameter of 30 mm. However, this is not the only structure of the endless belt 83. A belt member may be used which is made of a metal such as nickel, stainless steel, or iron. Further, the internal diameter of the endless belt 83 is not limited to 30 mm. Note that the material of which the releasing layer of the endless belt 83 is made may be any material that is excellent in heat resistance and durability and that securely releases toner therefrom. Therefore, a fluorine-based material such as PFA may be used instead of PTFE.

Each of the supporting rollers 81 and 82 is a roller constituted by an aluminum shaft having an external diameter of 15 mm and a radial thickness of 1 mm. As required (e.g., in order to reduce friction force between the internal surface of the endless belt 83 and the respective peripheral surfaces of the supporting rollers 81 and 82 such that deviation force due to winding of the endless belt 83 is reduced), a releasing layer may be provided on the shaft of each of the supporting rollers 81 and 82. The material of which the releasing layer is made may be any material that is excellent in heat resistance and durability, and that securely releases toner therefrom. For example, a fluorine based material such as PFA and PTFE (polytetrafluoroethylene) can be used.

Each of the supporting rollers 81 and 82 is pressed against the peripheral surface of the fixing roller 60, with the endless belt 83 sandwiched therebetween, by a resilient member (spring) that is not shown in FIG. 1. This brings the surface of the endless belt 83 into contact with the peripheral surface of the fixing roller 60, and allows formation of a nip section between the surface of the endless belt 83 and the peripheral surface of the fixing roller 60. Note that the nip width (width in the circumferential direction of the fixing roller 60) between the surface of the endless belt 83 and the peripheral surface of the fixing roller 60 is 20 mm.

Further, slip shaft bearings are used in the ends of each of the supporting rollers 81 and 82. A material of which each of the slip shaft bearings is made is not particularly limited. The slip shaft bearing may be made of any heat resistant, abrasion resistant, and low friction material. For space saving, the slip shaft bearings are used in the present embodiment in which the supporting rollers 81 and 82 each having a small diameter are used to shorten a distance between the respective axes of the supporting rollers. However, the present invention is not limited to this. For example, in cases where there is no restriction in space, ball bearings may be used.

Further, a thermistor (first temperature sensor, first temperature detecting section) 85 is provided in contact with the external surface of a contact portion of the endless belt 83 with the first supporting roller 81. The thermistor 85 detects a surface temperature of the endless belt 83. Provided inside the first supporting roller 81 is a halogen lamp (first heat source device, first heating section) 86 for carrying out heat radiation in response to supply of electric power. The halogen lamp 86 serves as a heat source for the endless belt 83. When electric power is supplied to the halogen lamp 86, the halogen lamp 86 radiates heat so as to heat the endless belt 83 via the supporting roller 81. The endless belt 83 thus heated is in contact with the peripheral surface of the fixing roller 60, so that the peripheral surface thereof can be heated via the contact portion of the endless belt 83 with the fixing roller 60. In the present embodiment, each of the two supporting rollers 81 and 82 has the small radial thickness and the small diameter, and the endless belt 83 is thin, so that the temperature of the endless belt 83 can be raised quickly.

Because the supporting rollers 81 and 82 have the same shape and are heated by the same heat source in the present embodiment, there is provided one temperature detecting element (thermistor) for use in controlling the surface temperature of the endless belt 83. However, the present invention is not limited to this. For example, the supporting rollers 81 and 82 may have different shapes, and heat sources may be provided respectively for the supporting rollers 81 and 82. In this case, a plurality of thermistors may be provided so as to detect surface temperatures of the supporting rollers 81 and 82 for the sake of the control, respectively.

Further, the endless belt 83 is set around the two supporting rollers in the present embodiment. However, a tension roller may be additionally provided as required, and the endless belt 83 may be set around three or greater rollers. (For example, if a wide nip width is secured between the fixing roller 60 and the endless belt 83, two supporting rollers are not enough to hold the endless belt 83.)

Further, the control device 90 is a control purpose integrated circuit substrate connected to the thermistors 65, 75, and 85, the halogen lamps 64, 74, and 86, and the rotation driving device 91 so as to control the temperature of the surface of the endless belt 83, the temperature of the peripheral surface of the fixing roller 60, the temperature of the peripheral surface of the pressure roller 70, and the rotation driving of the fixing roller 60. Note that electric power is supplied from a power source (electric power supplying section 92) to each of the halogen lamps 64, 74, and 86. In accordance with each result of the temperature detection of the thermistors 65, 75, and 85, the control device 90 changes a division rate of electric power to be supplied to each of the halogen lamps, thus controlling the calorific power of each of the halogen lamps. Accordingly, the respective temperatures of the endless belt 83, the fixing roller 60, and the pressure roller 70 are controlled.

Figure 3:
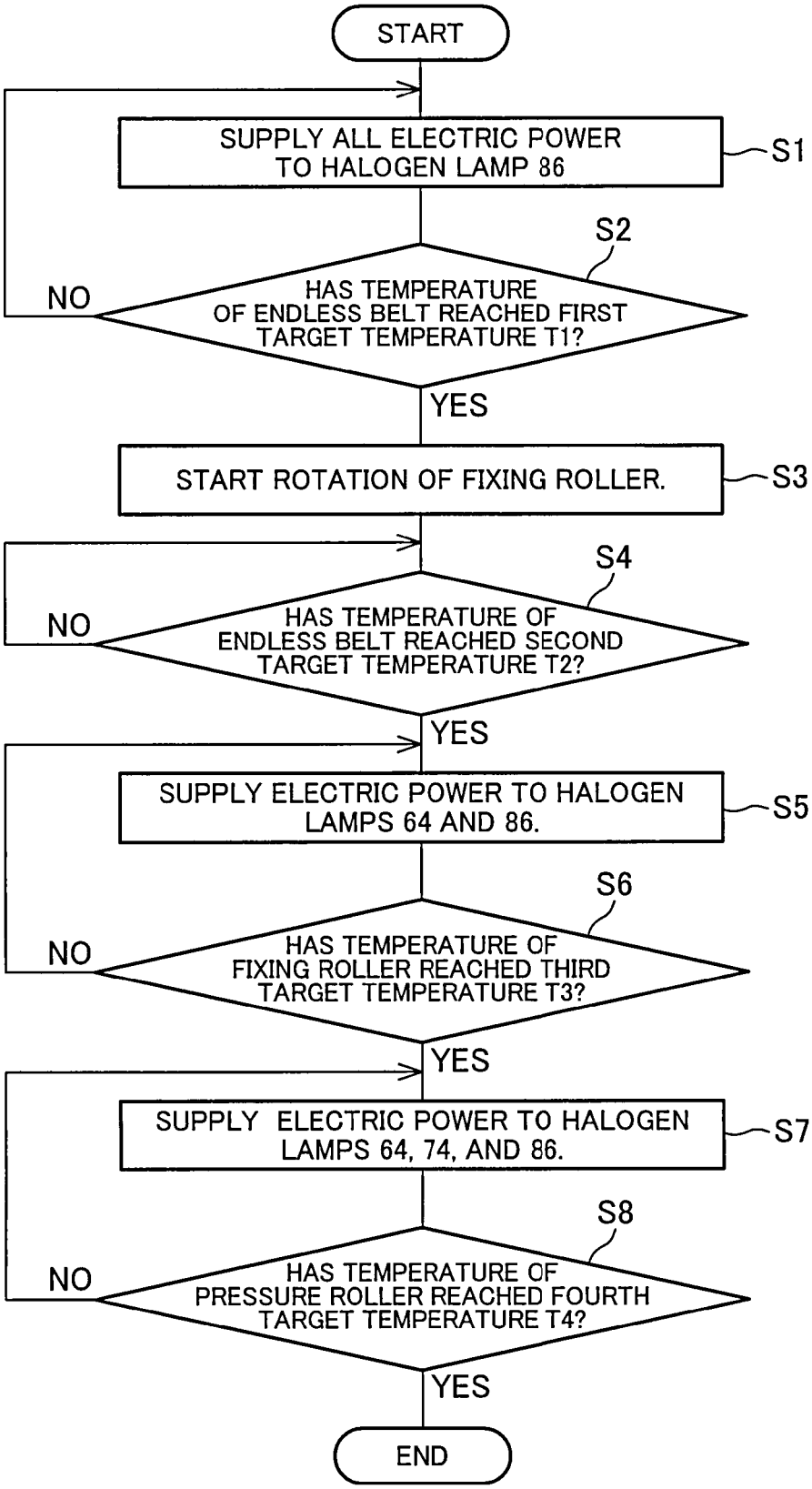
FIG. 3 is a flowchart illustrating a flow of processes carried out upon warm-up of the fixing apparatus according to the embodiment of the present invention.
Figure 4:
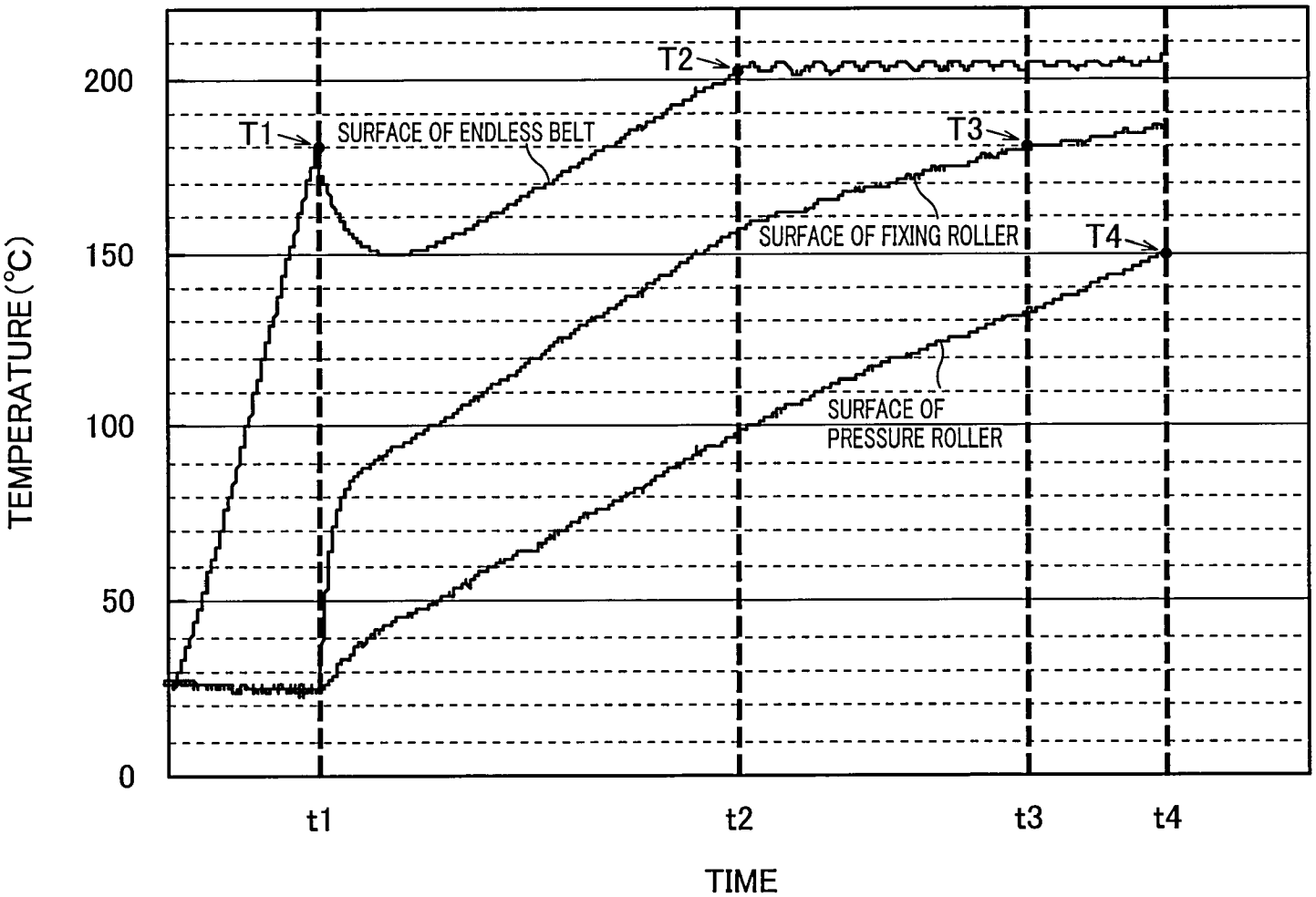
FIG. 4 is a graph illustrating respective how respective surface temperatures of an endless belt, a fixing roller, and a pressure roller each provided in the fixing apparatus according to the embodiment of the present invention change upon the warm-up.

Explained next are processes carried out by the control device 90 during warm-up of the fixing apparatus 40, with reference to FIG. 3 and FIG. 4. FIG. 3 is a flowchart illustrating a flow of the processes carried out by the control device 90 during the warm-up. FIG. 4 is a graph illustrating respective changes of surface temperatures of the endless belt 83, the fixing roller 60, and the pressure roller 70 during the warm-up.

In the present embodiment, the warm-up operation is started at a room temperature (25° C.) under such conditions that the fixing roller 60 is not rotated, and is continued until the surface temperatures of the endless belt 83, the fixing roller 60, and the pressure roller 70 reach predetermined warm-up completion temperatures respectively. The warm-up completion temperature (second target temperature T2) of the endless belt 83 is set at 205° C. The warm-up completion temperature (third target temperature T3) of the fixing roller 60 is set at 180° C. The warm-up completion temperature (fourth target temperature T4) of the pressure roller 70 is set at 150° C.

Upon the warm-up of the fixing apparatus 40, the control device 90 firstly supplies electric power to the halogen lamp 86 provided in the first supporting roller 81 of the external heating device 80, with the result that a heating operation in the external heating device 80 is started (S1). On this occasion, the control device 90 supplies, to the halogen lamp 86, all the heating purpose electric power that could be used to heat the endless belt 83, the fixing roller 60, and the pressure roller 70 (the halogen lamps 64, 74, and 86) of the fixing apparatus 40.

Next, the control device 90 judges whether or not the surface temperature of the endless belt 83, i.e., the temperature detected by the thermistor 85 has reached a first target temperature T1 (S2). Here, the first target temperature T1 is set at such a temperature that the endless belt 83 is restored its normal shape from the deformed shape that the endless belt 83 had as a result of being left for a long time with no rotation of the endless belt 83. In the present embodiment, the first target temperature T1 is set at 180° C. Note that the external heating device 80 has the small heat capacity as described above, so that it takes very short time t1 from the start of the warm-up operation for the surface temperature of the endless belt 83 to reach the first target temperature T1.

In cases where it is judged in S2 that the temperature detected by the thermistor 85 has not reached the first target temperature T1, the control device 90 keeps on supplying electric power to the halogen lamp 86, and keeps on monitoring whether or not the temperature detected by the thermistor 85 has reached the first target temperature T1.

On the other hand, in cases where it is judged in S2 that the temperature detected by the thermistor 85 has reached the first target temperature T1, the control device 90 controls the rotation driving device 91 such that the fixing roller 60 is started to rotate (S3). In this way, the fixing roller 60 and the external heating device 80 are started to rotate. When the fixing roller 60 is started to rotate, the surface temperature of the endless belt 83 is temporarily decreased but then is increased as shown in FIG. 4.

Thereafter, the control device 90 monitors whether or not the temperature detected by the thermistor 85 has reached the second target temperature T2 (S4).

When the temperature detected by the thermistor 85 reaches the second target temperature T2, the heating purpose electric power, which has been supplied only to the halogen lamp 86 of the external heating device 80, is so divided as to be supplied to the halogen lamp 86 and the halogen lamp 64 of the fixing roller 60 (S5). More specifically, when the temperature detected by the thermistor 85 reaches the second target temperature T2, the control device 90 carries out control such that: electric power for maintaining the surface temperature of the endless belt 83 at the second target temperature T2 is to be supplied to the halogen lamp 86, and the rest of the heating purpose electric power is to be supplied to the halogen lamp 64. Alternatively, when the temperature detected by the thermistor 85 is equal to or higher than the second target temperature T2, electric power may be supplied only to the halogen lamp 64. Note that, as shown in FIG. 4, the surface temperature of the fixing roller 60 at this moment is rather high (approximately 160° C. in FIG. 4) due to heat conducted from the endless belt 83.

Next, the control device 90 judges whether or not the surface temperature of the fixing roller 60, i.e., the temperature detected by the thermistor 65 has reached the third target temperature T3 (S6). In cases where it is judged that the temperature detected by the thermistor 65 has not reached the third target temperature T3, the control device 90 keeps on supplying the electric power to the halogen lamps 64 and 86, and keeps on monitoring whether or not the temperature detected by the thermistor 65 has reached the third target temperature T3.

On the other hand, in cases where it is judged in S6 that the temperature detected by the thermistor 65 has reached the third target temperature T3, the control device 90 divides the heating purpose electric power having been supplied to the halogen lamps 64 and 86, into (i) electric power to be supplied to the halogen lamp 86, (ii) electric power to be supplied to the halogen lamp 64, and (iii) electric power to be supplied to the halogen lamp 74 (S7). More specifically, when the temperature detected by the thermistor 65 has reached the third target temperature T3, the control device 90 carries out control such that: electric power for maintaining the surface temperature of the endless belt 83 at the second target temperature T2 is to be supplied to the halogen lamp 86, electric power for maintaining the surface temperature of the fixing roller 60 at the third target temperature T3 is to be supplied to the halogen lamp 64, and the rest of the heating purpose electric power is to be supplied to the halogen lamp 74. Alternatively, when the temperature detected by the thermistor 65 is equal to or higher than the third target temperature T3 and the temperature detected by the thermistor 85 is equal to or higher than the second target temperature T2, all the electric power may be supplied only to the halogen lamp 74. Note that, as shown in FIG. 4, the surface temperature of the pressure roller 70 at this moment is rather high (approximately 130° C. in FIG. 4) due to heat conducted from the fixing roller 60.

Thereafter, the control device 90 judges whether or not the temperature of the peripheral surface of the pressure roller 70, i.e., the temperature detected by the thermistor 75 has reached the fourth target temperature T4 (S8). In cases where it is judged that the temperature detected by the thermistor 75 has not reached the fourth target temperature T4, the control device 90 keeps on supplying the electric power to the halogen lamps 64, 74, and 86, and keeps on monitoring whether or not the temperature detected by the thermistor 75 has reached the fourth target temperature T4.

On the other hand, in cases where it is judged in S8 that the temperature detected by the thermistor 75 has reached the fourth target temperature T4, the control device 90 ends the warm-up operation. With this, the fixing apparatus 40 is ready to carry out the fixing process.

As described above, in the warm-up operation of the fixing apparatus 40 according to the present embodiment, the control device 90 causes the endless belt 83 of the external heating device 80 to be heated up to the first target temperature T1 at which the endless belt 83 is softened, and then causes the endless belt 83 to be rotated. This makes it possible to prevent the rotation trouble occurring due to the deformed shape that the endless belt 83 had while no rotation was carried out.

Further, in the present embodiment, the control device 90 controls the amounts of the electric power, to be supplied to each of the halogen lamps, such that: the surface temperature of the endless belt 83 reaches the second target temperature, then the peripheral surface temperature of the fixing roller 60 reaches the third target temperature, and then the peripheral surface temperature of the pressure roller 70 reaches the fourth target temperature. More specifically, during a period of time from the start of the warm-up operation until the surface temperature of the endless belt 83 reaches the second target temperature T2, all the electric power usable for heating in the fixing apparatus 40 is supplied to the halogen lamp 86 provided for the endless belt 83 (the supply of the heating purpose electric power to the halogen lamp 86 is placed first priority in the fixing apparatus 40). When the surface temperature of the endless belt 83 reaches the second target temperature T2, the heating purpose electric power is supplied to the halogen lamp 86 for the endless belt 83 and the halogen lamp 64 of the fixing roller 60. Further, when the temperature of the peripheral surface of the fixing roller 60 reaches the third target temperature T3, the heating purpose electric power is supplied to the halogen lamp 86 for the endless belt 83, the halogen lamp 64 of the fixing roller 60, and the halogen lamp 74 of the pressure roller 70. In other words, priorities in supplying the heating purpose electric power are set in the order of (i) the external heating device 80, (ii) the fixing roller 60, and (iii) the pressure roller 70.

This shortens time taken for the surface temperature of the endless belt 83 to reach the first target temperature from the start of the warm-up operation, thereby shortening time required for the warm-up. Moreover, the surface temperature of the fixing roller can be raised efficiently.

Note that the first target temperature T1 may be set at a temperature at which the endless belt 83 is softened, and may be set arbitrarily according to a thermal property of the endless belt 83. However, it is preferable to set the first target temperature T1 at a temperature at which the endless belt 83 is softened by heat application and accordingly retrieves its flexibility so as not to cause the rotation trouble occurring due to the deformed shape that the endless belt 83 had as a result of being left for a long time with no rotation of the endless belt 83. Further, it is preferable to set the first target temperature at a temperature at which toner is melted, e.g., to set at a temperature equal to or higher than the toner 4 mm descendent temperature. Here, the wording "toner 4 mm descendent temperature" refers to a temperature at which measurement by a heat melting property measuring device (e.g., a flow tester (CFT-500 provided by Shimadzu Corporation)) in which toner particles are set shows that a piston for imposing loads on the toner descends by 4 mm due to toner meltdown caused by increasing temperature at a constant speed under such conditions that: a die aperture is so set as to have a diameter of 1 mm and a height of 1 mm, load is set at 20 kgf/cm$^2$, the temperature is increased at a speed of 6° C./minute, and the sample has a weight of 1 g. Note that the toner 4 mm descendent temperature is 120° C. in the present embodiment.

As such, the first target temperature T1 is set at the temperature at which toner is melted, so that the rotation of the fixing roller 60 can be started after the toner is melted. This makes it possible to prevent the respective surfaces of the fixing roller 60 and the endless belt 83 from being scratched due to friction therebetween caused by toner adhered to the surface of the endless belt 83.

Further, it is preferable that the endless belt 83 have an internal circumferential length (length of the internal peripheral surface extending in the rotation direction; effective length of the belt) L5, which satisfies $0.1\ \text{mm} \leqq L5 - L4 < 3\ \text{mm}$ where L4 is a total of (i) a circumferential length L1 of a contact portion of the internal surface of the endless belt 83 with the surface of each of the supporting rollers when the endless belt 83 is set around the supporting rollers, (ii) a sum L2 of respective distances among the axes of adjacent supporting rollers provided in the direction in which the endless belt 83 is set around the supporting rollers, and (iii) a length L3 of the nip section at which the endless belt 83 and the fixing roller 60 make contact with each other ($L4 = L1 \times 2 + L2 + L3$). Thus, L4 represents a minimal internal circumferential length that the belt requires in theory so as to be set around the supporting rollers.

Figure 5:
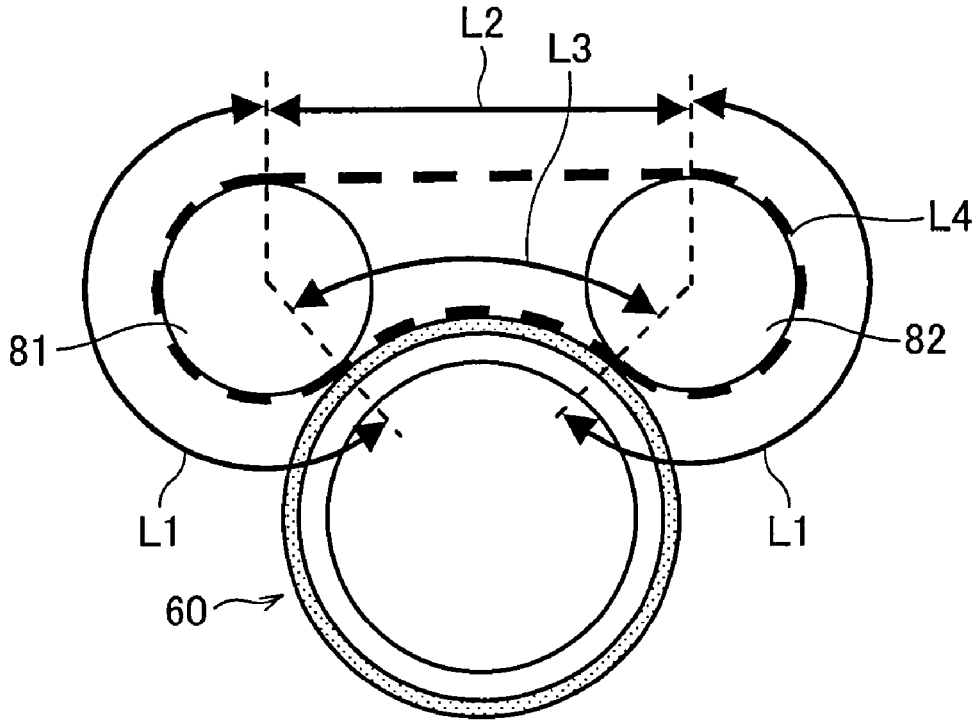
FIG. 5 is an explanatory diagram illustrating a circumferential length L4 of the endless belt, which circumferential length L4 is minimally required for setting the endless belt around supporting rollers in the fixing apparatus according to the embodiment of the present invention.

A reason for this is explained as follows. As shown in FIG. 5, the circumferential length L4 minimally required for setting the endless belt 83 around the supporting rollers 81 and 82 is made up of (i) the circumferential length L2 of the portion at which the surfaces of the supporting rollers 81 and 82 are in contact with the internal surface of the endless belt 83 when the endless belt 83 is set around the supporting rollers 81 and 82; (ii) the distance L2 between the axes of the supporting rollers 81 and 82 (sum of distances among adjacent supporting rollers provided in the direction in which the endless belt 83 is set); and (iii) the circumferential length L3 of the portion (nip section) in which the surface of the endless belt 83 and the surface of the fixing roller 60 are in contact with each other. Therefore, the circumferential length L4 minimally required for setting the supporting belts 83 around the supporting rollers 81 and 82 is expressed as $L4 = L1 \times 2 + L2 + L3$.

Experiment for finding whether or not the rotation trouble of the endless belt 83 occurs upon the warm-up operation was conducted for various cases where the circumferential length L4 and the rotation start temperature (first target temperature T1) differ. In this experiment, an endless belt having an internal circumferential length of 30 mm was used as the endless belt 83. The circumferential length L4 was changed by changing the distance between the axes of the two supporting rollers 81 and 82. Further, different rotation start temperatures are set for one circumferential length L4 in the experiment for finding whether or not the rotation trouble occurs upon the warm-up operation. Specifically, the experiment was carried out for the following cases: (1) L5–L4=0 mm and the rotation start temperature was 80° C.; (2) L5–L4=0 mm and the rotation start temperature was 120° C.; (3) L5–L4=0 mm and the rotation start temperature was 180° C.; (4) L5–L4=0.1 mm and the rotation start temperature was 80° C.; (5) L5–L4=0.1 mm and the rotation start temperature was 120° C.; (6) L5–L4=0.1 mm and the rotation start temperature was 180° C.; (7) L5–L4=1 mm and the rotation start temperature was 80° C.; (8) L5–L4=1 mm and the rotation start temperature was 120° C.; (9) L5–L4=1 mm and the rotation start temperature was 180° C.; (10) L5–L4=2 mm and the rotation start temperature was 80° C.; (11) L5–L4=2 mm and the rotation start temperature was 120° C.; (12) L5–L4=2 mm and the rotation start temperature was 180° C.; (13) L5–L4=3 mm and the rotation start temperature was 80° C.; (14) L5–L4=3 mm and the rotation start temperature was 120° C.; (15) L5–L4=3 mm and the rotation start temperature was 180° C. With this, respective rotation states for these cases were found. Table 1 shows results of the experiment.

TABLE 1

| | | L5-L4 | | | | |
|---|---|---|---|---|---|---|
| | | 0 mm | 0.1 mm | 1 mm | 2 mm | 3 mm |
| Rotation start temperature | 80° C. | X | X | X | X | X |
| | 120° C. | X | X | ○ | ○ | Δ |
| | 180° C. | X | ○ | ○ | ○ | Δ |

○: Rotation is good;
Δ: Occurrence of winding;
X: Occurrence of rotation trouble just after start of rotation As shown in Table 1, when the rotation start temperature was set at 80° C., the rotation trouble occurred irrespective of a value of L5–L4. In other words, when the rotation start temperature was 80° C., the endless belt 83 still remained in the deformed shape that the endless belt 83 had had while the endless belt 83 was not rotated, with the result that the rotation trouble occurred.

Further, when L5–L4=0 mm, the rotation trouble occurred irrespective of the rotation start temperature. In other words, when L5–L4=0, tension (tensile force) exerted to the endless belt 83 while the endless belt 83 was not rotated was so strong that the endless belt 83 had a deformed shape in which the endless belt 83 stably remained even when heated up to 120° C. and 180° C. As a result, the rotation trouble occurred.

When L5–L4=0.1 mm and the rotation start temperature was set at 120° C., the rotation trouble occurred. However, when L5–L4=0.1 mm and the rotation start temperature was set at 180° C., no rotation trouble occurred. When L5–L4=0.1 mm, tension exerted on the endless belt 83 while the endless belt 83 was not rotated was relatively strong, so that the endless belt 83 had a deformed shape in which the endless belt 83 remained even when heated up to 120° C. As a result, the rotation trouble occurred. However, by setting the rotation start temperature at 180° C., the endless belt 83 was restored to its normal shape from the deformed shape and then was rotated, so that the rotation trouble was prevented.

Further, when 1 mm≦L5–L4≦2 mm and the rotation start temperature was set at 120° C., no rotation trouble occurred and the endless belt 83 was rotated in an appropriate manner.

When L5–L4=3 mm and the rotation start temperature was set at 120° C. or higher, no rotation trouble occurred just after the start of the rotation. That is, the endless belt 83 was restored to its normal shape from the deformed shape that the endless belt 83 had had while no rotation was carried out. Then, the endless belt 83 thus restored was started to be rotated, so that no rotation trouble due to the deformed shape occurred. However, as the rotation went on, the endless belt 83 was winded, with the result that the edge portion of the endless belt 83 was broken.

These results indicate that: in cases where the tension exerted on the endless belt 83 while the endless belt 83 is not rotated is too strong, the endless belt 83 is caused to have a deformed shape in which the endless belt 83 stably remains even when heat is applied thereto before the start of the rotation, with the result that the rotation trouble occurs. Therefore, it is preferable to set the value of L5–L4 at a value (0.1 mm≦L5–L4 in the present embodiment) at which the tension is so weak that heat application allows the endless belt 83 to be restored to its normal shape from the deformed shape that the endless belt had while no rotation was carried out.

However, when the tension exerted on the endless belt 83 is too weak, the endless belt 83 is winded. Therefore, it is preferable to set the value of L5–L4≦2 mm in the present embodiment) at which tension that never causes the winding of the endless belt 83 is obtained.

Further, in the present embodiment, the thermistor 85 provided in contact with the endless belt 83 is used as the temperature detecting means for detecting the surface temperature of the endless belt 83; however, the present invention is not limited to this. For example, instead of the thermistor 85, a non-contact type temperature detecting means may be used. Further, the thermistor 85 and a non-contact type thermistor may be used together. In this case, for example, the non-contact type thermistor is not used for temperature control carried out under a normal condition, but is used as means (e.g., a thermostat) for stopping supply of electric power to each of the halogen lamps when the non-contact type thermistor detects an abnormal temperature.

Figure 6:
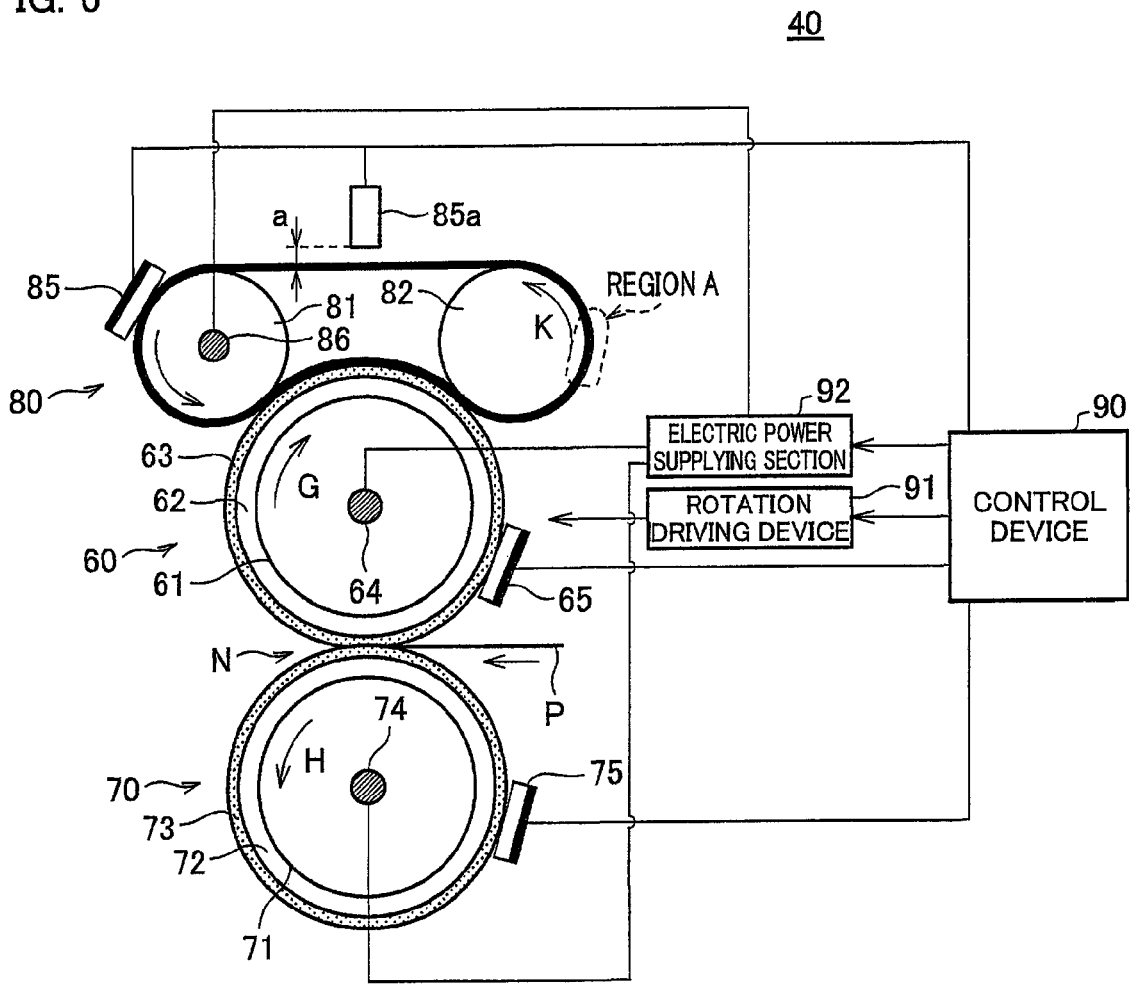
FIG. 6 is an explanatory diagram illustrating an example of a structure, which the fixing apparatus according to the embodiment of the present invention has and in which non-contact type temperature detecting means is used to detect the surface temperature of the endless belt.

FIG. 6 is an explanatory diagram illustrating an example of a structure of a fixing apparatus 40 using a temperature detecting section (first temperature detecting section or second temperature detecting section) 85*a* serving as the non-contact type temperature detecting means. In the example shown in FIG. 6, the temperature detecting section 85*a* is provided in the vicinity of the endless belt 83 (provided such that a distance between the temperature detecting section 85*a* and the loop section 83 is a (mm)) so as to face the endless belt 83 but so as not to face the supporting rollers 81 and 82. In the present embodiment, the distance a therebetween is 2 mm. Note that the temperature detecting section 85*a* may be any non-contact type temperature detecting means that is capable of detecting the surface temperature of the endless belt 83, and therefore is not particularly limited. However, examples of the temperature detecting section 85*a* include: a thermostat, a temperature fuse, a thermistor, and the like.

Figure 7:
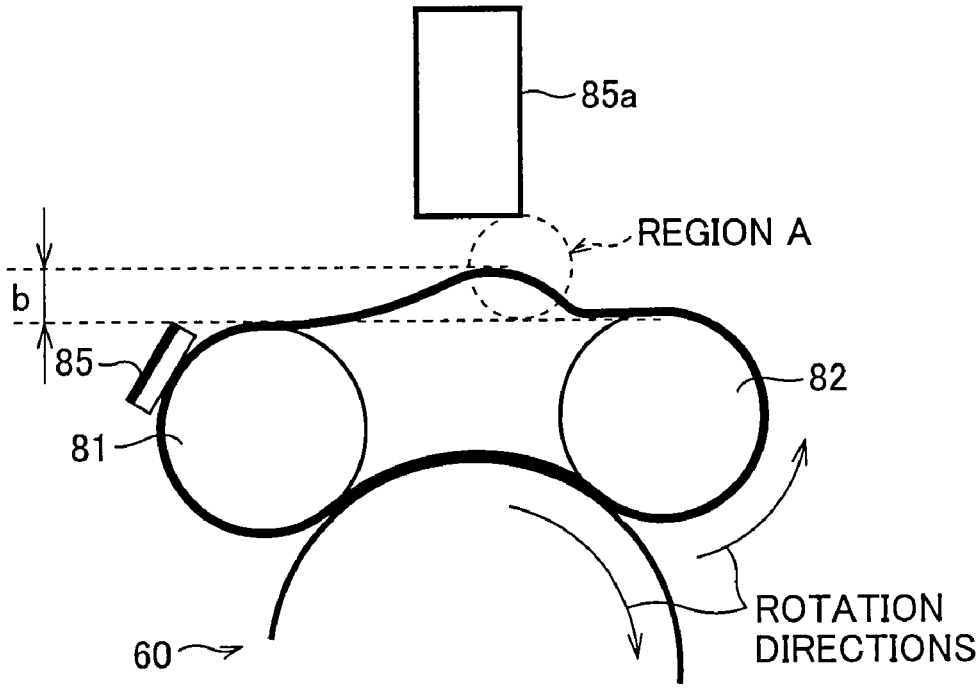
FIG. 7 is an explanatory diagram illustrating protrusion existing in the endless belt when rotation of the endless belt is started before the endless belt is restored to its normal shape from a deformed shape that the endless belt had while it was not rotated.

Meanwhile, when the endless belt 83 is set around the supporting rollers 81 and 82 and is left for a long time with no rotation, the endless belt 83 is caused to have deformed portions respectively reflecting (i) the shape of the supporting roller 82 (see a region A in FIG. 6) and (ii) the shape of the contact region of the supporting roller 81. Now, consider a case where the endless belt 83 having such deformed portions is not sufficiently heated but is started to rotate. As the endless belt 83 is rotated, the region A, which is the deformed portion reflecting the shape of the supporting roller 82, is brought to a space between the supporting rollers 81 and 82 (is brought out of contact with the supporting rollers 81 and 82). As shown in FIG. 7, the region A thus brought to the space protrudes higher than a height that the endless belt 83 is supposed to have.

Now, assume that: a protrusion amount (projection amount) of this portion (hereinafter, referred to as "facing portion"), facing the temperature detecting section 85*a* on this occasion, is expressed by b (mm), that is, a difference between (i) the height of the facing portion of the endless belt 83 in its normal shape and (ii) the height of the facing portion of the endless belt 83 in the deformed shape is expressed by b (mm). Therefore, when b≧a, the endless belt 83 meets the temperature detecting section 85*a*.

When the endless belt 83 meets the temperature detecting section 85*a*, troubles occur. For example, the temperature detecting section 85*a* thus meeting the endless belt 83 wrongly detects the surface temperature of the temperature detecting section 85*a*, so that the control device 90 carries out control in accordance with such a wrong control temperature. Moreover, the meeting with the endless belt 83 causes breakage of the temperature detecting section 85*a* (e.g., breakdown of the thermostat (temperature fuse) used as the temperature detecting section 85*a*). Otherwise, the surface of the endless belt 83 is scratched as a result of the meeting.

In consideration of this, in cases where the non-contact type temperature detecting means is provided face to face with the endless belt 83 but not face to face with the supporting rollers 81 and 82, it is preferable to set the first target temperature T1 at a temperature at which the protrusion amount b of the deformed portion formed in the endless belt 83 while no rotation was carried out becomes smaller than the distance a (b>a). This makes it possible that: when the endless belt 83 is started to rotate, the temperature detecting section 85*a* is prevented from meeting the deformed portion formed in the endless belt 83 while no rotation was carried out.

Further, the fixing apparatus 40 according to the present embodiment may be arranged such that the control device 90 carries out control of preventing the temperature of the external heating device 80 from being too high when the rotation trouble of the endless belt 83 occurs.

Figure 8:
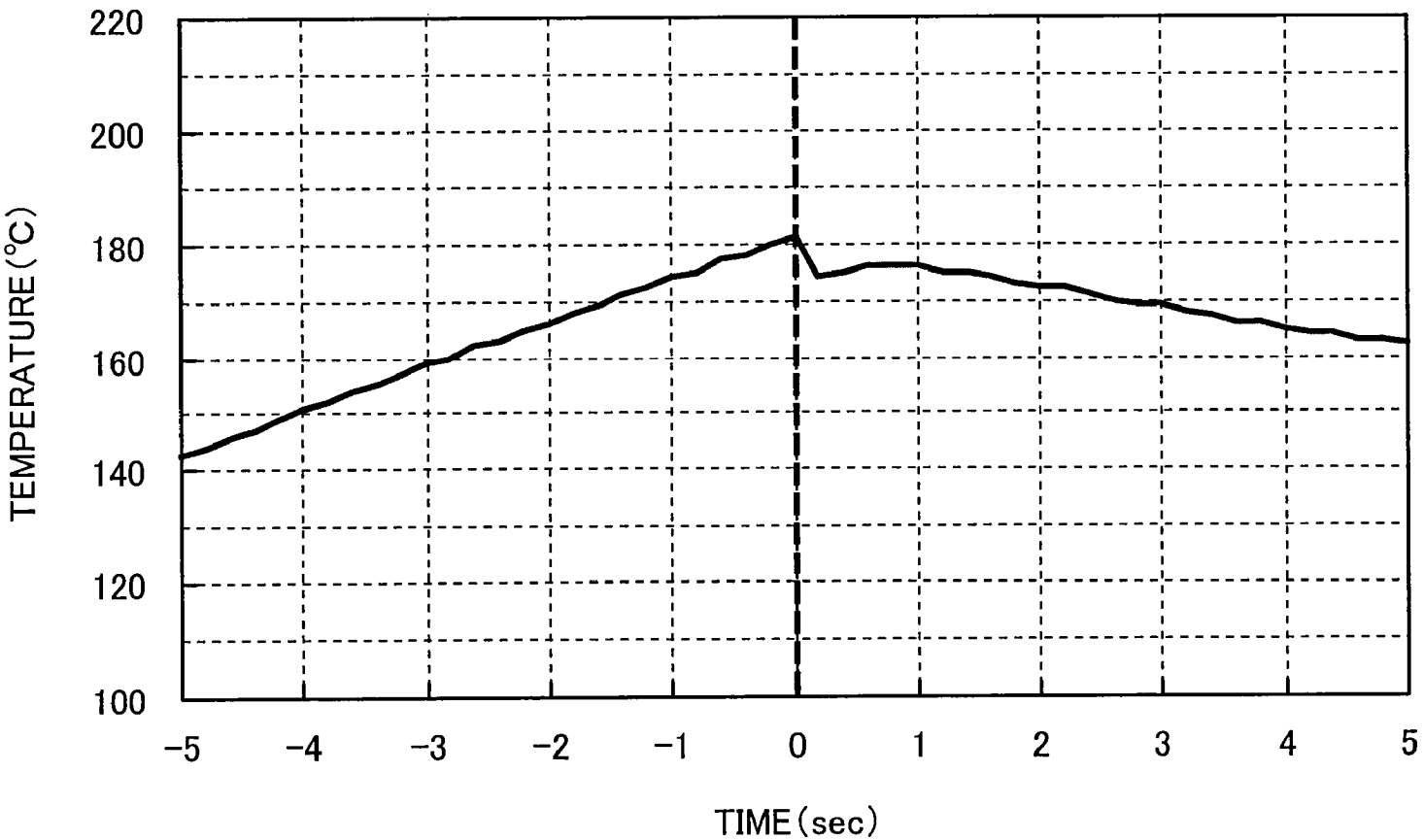
FIG. 8 is a graph focusing on the temperature changes (see the graph of FIG. 4) occurring around the start of the rotation operation.

See FIG. 4 illustrating changes of the temperature detected by the thermistor 85 provided in contact with the endless belt 83. When no rotation trouble occurs, the temperature begins to decrease at the start of the rotation operation and then begins to increase. FIG. 8 is a diagram focusing on the changes of the temperature around the start of the rotation operation. Note that the time at which the rotation operation is started is indicated as "0 second". As shown in FIG. 4 and FIG. 8, the temperature reaches the rotation start temperature 180° C. (first target temperature T1), and then is decreased simultaneously with the start of the rotation operation.

Figure 9:
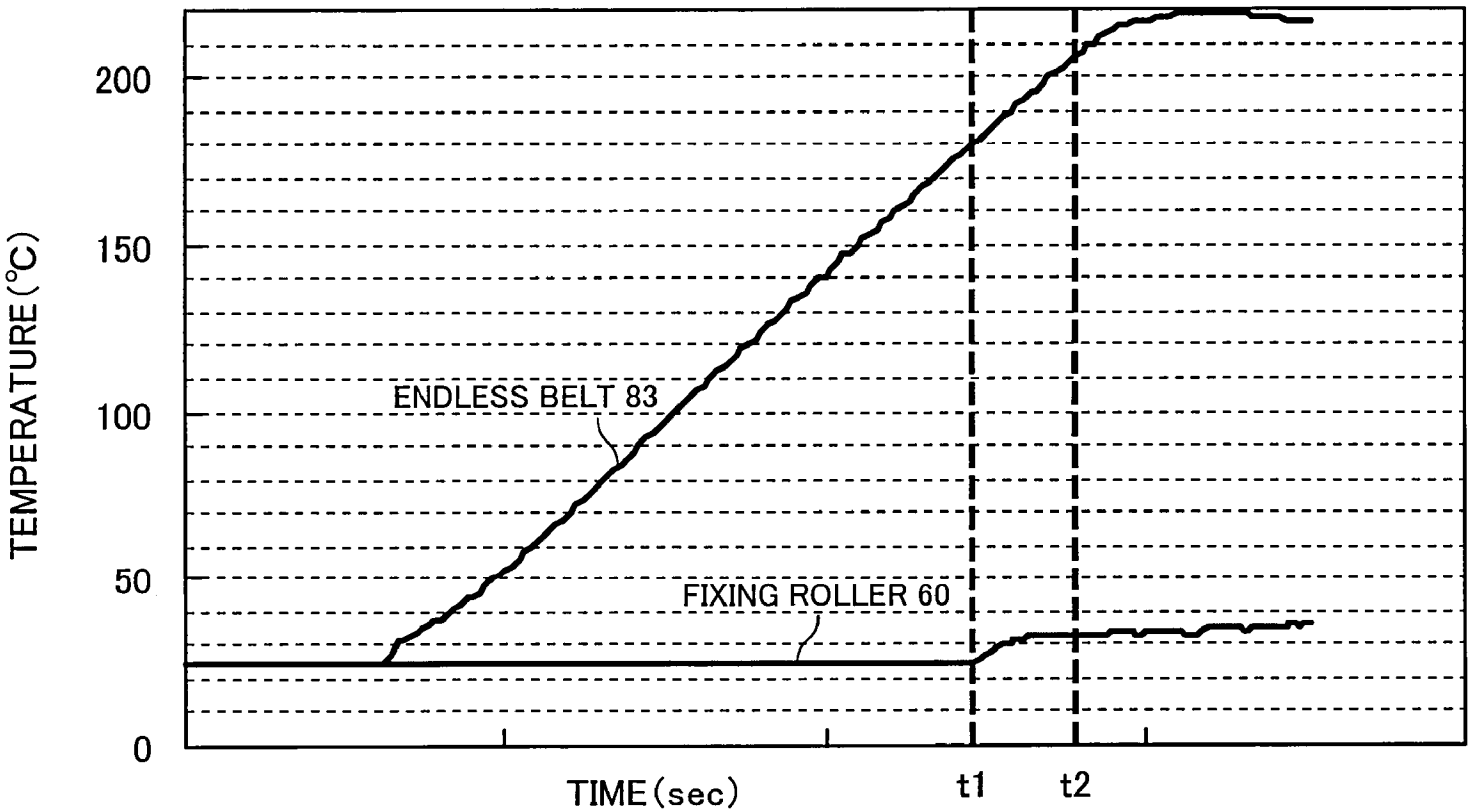
FIG. 9 is a graph illustrating how the surface temperatures of the endless belt and the fixing roller are changed when a rotation trouble of the endless belt occurs.

Meanwhile, FIG. 9 is a graph illustrating changes of the respective surface temperatures that the endless belt 83 and the fixing roller 60 have when the rotation trouble occurs during the rotation operation of the endless belt 83. As shown in FIG. 9, when the rotation trouble occurs during the rotation operation that has started at a time t1 at which the temperature detected by the thermistor 85 provided in the external heating device 80 reaches the first target temperature T1 (180° C.), the temperature detected by the thermistor 85 is never decreased but is kept on increasing until the temperature control is made at a time t2 at which the temperature reaches a heat temperature of 205° C. (second target temperature T2) (at which the heating purpose electric power is divided at a ratio of 64 to 86). As a result, the supply of heat to the external heating device 80 is controlled. However, overshoot occurs then, so that the surface temperature of the endless belt 83 is increased up to 220° C.

Figure 10:
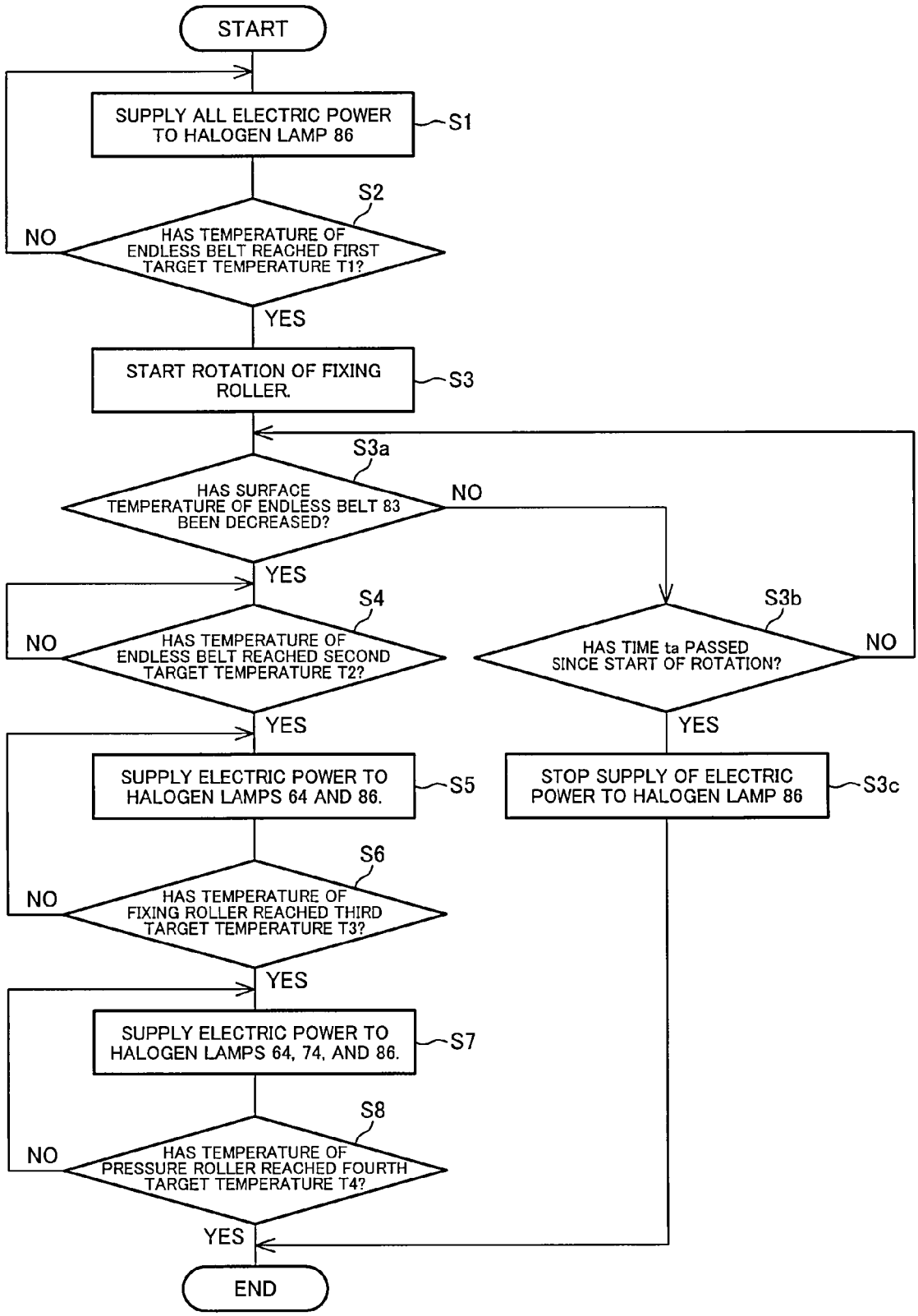
FIG. 10 is a flowchart illustrating processes carried out in cases where control is carried out so as to stop heating of the external heating device when the rotation trouble is detected in the fixing apparatus according to the embodiment of the present invention.

In order to prevent the temperatures of the endless belt 83 and the supporting roller 81 from rising too high due to overshoot even if the rotation trouble of the endless belt 83 occurs, the control device 90 monitors the temperature changes of the external heating device 80 (endless belt 83) for a predetermined period of time after the start of the rotation operation. In cases where no temperature decrease occurs within the predetermined period of time, the control device 90 stops the supply of the electric power to the halogen lamp 86. FIG. 10 is a flowchart illustrating a flow of processes carried out in cases where the above control is performed upon the warm-up.

For the warm-up of the fixing apparatus 40, the control device 90 firstly carries out the processes S1 through S3 shown in FIG. 3. The control device 90 causes the fixing roller 60 to start rotating in the process S3, and then monitors the temperature, detected by the thermistor 85 of the external heating device 80, so as to judge whether or not the surface temperature of the endless belt 83 has been decreased (S3*a*). In cases where it is judged that the surface temperature of the endless belt 83 has been decreased, the control device 90 carries out the processes S4 and later (see FIG. 3), thus completing the warm-up.

On the other hand, in cases where it is judged in S3*a* that the surface temperature of the endless belt 83 has not been decreased, the control device 90 judges whether or not a predetermined time (short time) ta has passed since the start of the rotation of the fixing roller (S3*b*). Note that a timer (time measuring section) for measuring passage of time may be provided in the control device 90, or may be provided separately from the control device 90. Further, the predetermined time ta may be arbitrarily set such that: in response to the occurrence of the rotation trouble, the supply of electric power to the halogen lamp 86 is stopped before the excessive temperature rise that would cause troubles such as (i) breakage of the endless belt 83 and of the coating layer of the fixing roller 60, and (ii) twisting of the supporting roller 81. It is assumed here that the predetermined time ta is 0.5 second.

In cases where it is judged that the predetermined time ta has not been passed, the control device 90 carries out the process S3*a* again so as to monitor whether or not the surface temperature of the endless belt 83 has been decreased.

On the other hand, in cases where it is judged in S3*b* that the predetermined time ta has been passed, the control device 90 judges that the rotation trouble is currently occurring, and stops the supply of electric power to the halogen lamp 86 (S3*c*), thereby aborting the warm-up operation and terminating the sequence.

Figure 11:
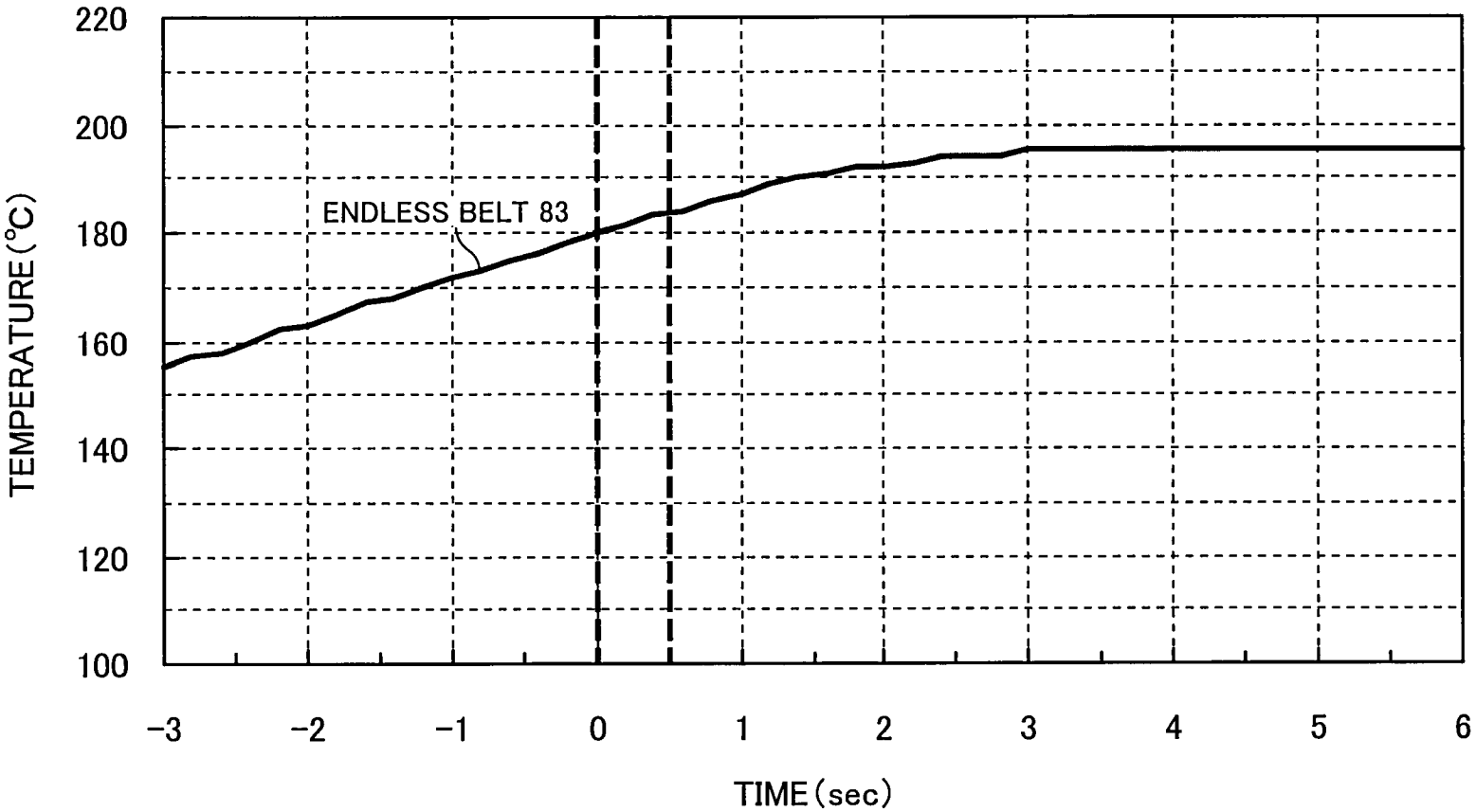
FIG. 11 is a graph illustrating how the temperature of the endless belt is changed when the control of FIG. 10 is carried out in response to the detection of the rotation trouble.

FIG. 11 is a graph illustrating how the surface temperature of the endless belt 83 is changed upon the occurrence of the rotation trouble of the endless belt 83, under such control that the supply of electric power to the halogen lamp 86 is stopped if no temperature decrease occurs 0.5 second after the start of the rotation as described above. As shown in FIG. 11, by stopping the supply of electric power 0.5 second after the start of rotation, the rise of the temperature of the endless belt 83 is restrained: 195° C. or lower.

As such, it is possible to judge whether or not the rotation trouble of the endless belt 83 is currently occurring, by monitoring (i) whether or not the predetermined time has been passed since the start of the rotation operation and (ii) how the temperature of the external heating device 80 is changed. Specifically, when the decrease of the temperature of the external heating device 80 is found as a result of monitoring the changes of the temperature of the external heating device 80 for the predetermined time ta from the start of the rotation operation, it is judged that the rotation is being carried out normally, so that the heating is continued. On the other hand, when it is found the temperature of the external heating device 80 keeps on rising, it is judged that the rotation trouble is currently occurring, so that the supply of electric power to the halogen lamp 86 is stopped. This prevents excessive temperature rising of the external heating device 80, thereby preventing problems such as (i) breakage of either the endless belt 83 or the coating layer of the fixing roller 60 due to the excessive temperature rising and (ii) twisting of the supporting roller 81.

Further, the fixing apparatus 40 according to the present embodiment may be provided with a releasing/contacting mechanism (releasing and contacting mechanism) for bringing the external heating device 80 out of contact with the fixing apparatus 40 and bringing the external heating device 80 into contact with the fixing apparatus 40. Each of FIG. 12(*a*) and FIG. 12(*b*) is an explanatory diagram illustrating an example of such a structure in which the releasing/contacting mechanism is provided. FIG. 12(*a*) illustrates that the external heating device 80 is brought into contact with the fixing roller 60. FIG. 12(*b*) illustrates that the external heating device 80 is brought out of contact with (is separated from) the fixing roller 60. Note that the components other than the releasing/contacting mechanism are identical to those in the structure shown in FIG. 1, so that some components are omitted in each of FIG. 12(*a*) and FIG. 12(*b*) for simplicity.

The external heating device 80 shown in each of FIG. 12(*a*) and FIG. 12(*b*) includes such a releasing/contacting mechanism that is made up of lateral plates 101, an arm 102, an eccentric cam 103, a fulcrum 104, a fulcrum 105, and a spring 106. The lateral plates 101 are provided on the ends of each of the supporting rollers 81 and 82, respectively. The lateral plates 101 supports the supporting rollers 81 and 82 via bearings (not shown) such that the supporting rollers 81 and 82 are rotatable. The lateral plate 101 is supported by the arm 102 at the fulcrum 104 so as to be rotatable in a direction perpendicular to the axis direction of each of the supporting rollers 81 and 82.

The arm 102 has one end rotatably supported by a frame of the fixing apparatus 40 (not shown) at the fulcrum 105. The arm 102 is biased by the spring 106 with respect to the fulcrum 105, in a direction toward the fixing roller 60.

The eccentric cam 103 is provided in contact with the other end of the arm 102. The eccentric cam 103 is driven by driving means (not shown) to rotate. A specific example of the driving means is a motor or the like. An operation of the driving means is controlled by the control device 90. Therefore, the control device 90 controls the driving means such that the eccentric cam 103 is rotated so as to move the arm 102 away from the fixing roller 60 (see FIG. 12(*a*)) or move the arm 102 toward the fixing roller 60 (See FIG. 12(*b*)). By moving the arm 102 as such, it is possible to press the endless belt 83 against the fixing roller 60 or to bring the endless belt 83 out of contact with the fixing roller 60.

Note that the above explanation assumes that the endless belt 83 and the fixing roller 60 do not make contact with each other (do not form a heating nip, which is a portion at which the endless belt 83 and the fixing roller 60 make contact with each other) when the external heating device (endless belt 83) is moved away from the fixing roller 60; however, the present invention is not limited to this and the endless belt 83 and the fixing roller 60 may be slightly in contact with each other. For example, in cases where a distance in which the external heating device 80 travels away from the fixing roller 60 is short due to a matter of space, the endless belt 83 and the fixing roller 60 may be slightly in contact with each other.

If the endless belt 83 is brought into contact with the fixing roller 60 after the fixing roller 60 is started to rotate, the respective surfaces of the fixing roller 60 and the endless belt 83 are likely to be scratched due to slip between the endless belt 83 and the fixing roller 60 until the endless belt 83 is pressed against the fixing roller with a predetermined pressing force, with which the endless belt 83 is appropriately rotated according to the rotation of the fixing roller 60 (while the endless belt 83 makes contact with the fixing roller 60 with a pressing force smaller than a pressing force necessary for the endless belt 83 to appropriately rotate according to the rotation of the fixing roller). Further, when the endless belt 83 is not pressed against the fixing roller 60 with an appropriate pressing force, load (tension) is not sufficiently imposed on the endless belt 83, so that pressure exerted to the endless belt 83 in the axis direction of each of the supporting rollers 81 and 82 is out of balance (uneven in the axis direction). When the endless belt 83 is brought into contact with the fixing roller 60 with such uneven balance of pressure, the endless belt 83 is winded.

Therefore, in cases where the releasing/contacting mechanism is provided in the external heating device 80, it is preferable that the control device 90 cause the endless belt 83 to be brought into contact with the fixing roller 60 before the fixing roller 60 is started to rotate. With this, the endless belt 83 is rotated with a starting torque required for starting to rotate the fixing roller 60. This allows prevention of (i) slip of the endless belt 83 from the fixing roller 60, and (ii) winding of the endless belt 83.

Further, in the above embodiments, the control device 90 is constituted by a control purpose integrated circuit substrate; however, the present invention is not limited to this. The control device 90 may be realized by software with the use of a processor such as a CPU. In this case, for example, the control device 90 is made up of (i) a CPU (central processing unit) for executing instructions of a control program realizing each function; (ii) a ROM (read only memory) storing the above program; (iii) a RAM (random access memory) for expanding the program; (iv) a storage device (recording medium), such as a memory, storing the program and various types of data; and the like. Therefore, the object of the present invention is achieved by: (i) providing, in the control device 90, a recording medium in which a computer-readable program code (executable program, intermediate code program, a source program) of a control program of the control device 90 that is software for realizing the function is stored, and (ii) causing a computer (CPU, or MPU) to read out and execute the program code stored in the storage medium.

Examples of the recording medium are: tapes such as a magnetic tape and a cassette tape; magnetic disks such as a Floppy® disk and a hard disk; disks such as a CD-ROM (compact disk read only memory), a magnetic optical disk (MO), a mini disk (MD), a digital video disk (DVD), and a CD-Recordable (CD-R); and the like. Further, the recording medium may be: a card such as an IC card or an optical card; or a semiconductor memory such as a mask ROM, an EPROM (electrically programmable read only memory), EEPROM (electrically erasable programmable read only memory), or a flash ROM.

Further, the control device may be so arranged as to be connectable to a communication network, and the program code may be supplied to the control device via the network. The communication network is not particularly limited. Specific examples thereof are: the Internet, intranet, extranet, LAN (local area network), ISDN (integrated services digital network), VAN (value added network), CATV (cable TV) communication network, virtual private network, telephone network, mobile communication network, satellite communication network, and the like. Further, a transmission medium (channel) constituting the communication network is not particularly limited. Specific examples thereof are: (i) a wired channel using an IEEE1394, a USB (universal serial bus), a power-line communication, a cable TV line, a telephone line, a ADSL line, or the like; or (ii) a wireless channel using IrDA, infrared rays used for a remote controller, Bluetooth®, IEEE802.11, HDR (High Data Rate), a mobile phone network, a satellite connection, a terrestrial digital network, or the like. Note that the present invention can be realized by a form of a computer data signal (a series of data signals) embedded in a carrier wave realized by electronic transmission of the program code.

Further, in the present embodiment, the fixing member (fixing roller 60) and the pressure member (pressure roller 70) each having a roller-like shape are used; however, the present invention is not limited to this. Each of the fixing member and the pressure member may have a belt-like shape or a pad-like shape.

Further, in the present embodiment, the halogen lamps are provided inside the fixing roller 60 and the pressure roller 70, respectively; however, the present invention is not limited to this. For example, no halogen lamp may be provided in the pressure roller 70. Alternatively, no halogen lamp may be provided in each of the fixing roller 60 and the pressure roller 70.

As described above, a fixing apparatus of the present invention includes a fixing member; a pressure member; an external heating device, in which a belt set around a plurality of supporting rollers in contact with a peripheral surface of the fixing member is heated by a first heating section so as to heat the fixing member and the belt is rotated according to rotation of the fixing member; the fixing member and the pressure member sandwiching and transporting a recording material, so that an unfixed image formed on the recording material is fixed onto the recording material by heating from the fixing member, the fixing apparatus, further including: a first temperature detecting section for detecting a surface temperature of the belt; a rotation driving section for driving to rotate the fixing member; and a control section for causing the first heating section to heat the belt for start of rotation of the fixing member, and causing the rotation driving section to rotate the fixing member when the belt reaches a first target temperature at which the belt is softened.

Further, a method of the present invention for controlling a fixing apparatus, including a fixing member; a pressure member; an external heating device, in which a belt set around a plurality of supporting rollers in contact with a peripheral surface of the fixing member is heated by a first heating section so as to heat the fixing member and the belt is rotated according to rotation of the fixing member; the fixing member and the pressure member sandwiching and transporting a recording material, so that an unfixed image formed on the recording material is fixed onto the recording material by heating from the fixing member, the method including: a heating step of heating the belt by the first heating section; a temperature detecting step of detecting a surface temperature of the belt; and a rotation starting step of starting rotation of the fixing apparatus when the temperature detected in the temperature detecting step reaches a first target temperature at which the belt is softened.

According to the above fixing apparatus and the control method therefor, the first heating section is started to heat the belt first, in preparation for the start of the rotation of the fixing member that is not currently being rotated. Then, when the first temperature detecting section detects that the surface temperature of the belt has reached the first target temperature at which the belt is softened by heating, the rotation driving section is caused to start rotating the fixing member. In this way, the belt is softened and then is started to be rotated, so that it is possible to prevent a rotation trouble such as slip from occurring due to a deformed shape (bent shape) that the belt had while the belt was not rotated. With this, the fixing member is rotated according to the rotation of the fixing member in an appropriate manner.

The fixing apparatus of the present invention may be arranged such that: the control section sets the first target temperature at a temperature at which the belt is softened and restores flexibility so as not to cause any rotation trouble while the belt is rotated.

According to the above structure, it is possible to prevent a rotation trouble such as slip from occurring due to a deformed shape (bent shape) that the belt had while the belt was not rotated.

The fixing apparatus may further include: a non-contact type second temperature detecting section, provided out of contact with the belt but facing to the belt at a region where the belt is not contact with the supporting rollers, wherein: the control section sets the first target temperature at a temperature at which the belt is softened and restores flexibility such that the belt does not meet the second temperature detecting section while the belt is rotated.

According to the structure, the control section sets the first target temperature at the temperature at which the belt is softened and restores flexibility such that the belt does not meet the second temperature detecting section while the belt is rotated. This prevents the belt from meeting the second temperature detecting section, thereby preventing troubles such as (i) wrong detection done by the second temperature detection section as the result of the meeting, and (ii) breakage of the second temperature detecting section as the result of the meeting.

Further, the fixing apparatus of the present invention may be arranged such that the control section sets the first target temperature at which toner is melted.

According to the above structure, the first target temperature is set at the temperature at which toner is melted. Therefore, toner (e.g., very small amount of offset toner obtained as a result of a sheet-passing operation) adhered to and accumulated on the surface of the belt is heated and therefore melted, and then the fixing member is started to rotate. This makes it possible that the toner accumulated on the surface of the belt scratches the respective surfaces of the fixing member and the belt. Note that: the temperature at which toner is melted may be set at "toner 4 mm descendent temperature". The wording "toner 4 mm descendent temperature" refers to a temperature at which measurement by a heat melting property measuring device (e.g., a flow tester (CFT-500 provided by Shimadzu Corporation)) in which toner particles are set shows that a piston for imposing loads on the toner descends by 4 mm due to toner meltdown caused by increasing temperature at a constant speed under such conditions that: a die aperture is so set as to have a diameter of 1 mm and a height of 1 mm, load is set at 20 kgf/cm$^2$, the temperature is increased at a speed of 6° C./minute, and the sample has a weight of 1 g.

The fixing apparatus of the present invention may further include: a releasing and contacting mechanism for separating the belt from the fixing member, wherein: the control section causes the releasing and contacting mechanism to bring the belt into contact with the fixing member, before the start of the rotation of the fixing member.

If the belt is brought into contact with the fixing member after the fixing member is started to rotate, the respective surfaces of the fixing member and the belt are likely to be scratched due to slip between the belt and the fixing member until the belt is appropriately pressed against the fixing member. Further, pressure exerted to the belt in the rotation axis direction of belt becomes out of balance (uneven in the axis direction), so that the belt is possibly winded. However, according to the above structure, the control section brings the belt into contact with the fixing member before the start of the rotation of the fixing member, so that the belt can be rotated by a starting torque required for starting to rotate the fixing member. This allows prevention of the slip and the winding of the belt.

Further, the fixing apparatus of the present invention may be arranged such that: 0.1 mm≦L5−L4≦2 mm is satisfied, where L4 represents a minimal internal circumferential length that the belt requires in theory so as to be set around the supporting rollers, and L5 represents an internal circumferential length that the belt actually has when the belt is set around the supporting rollers.

When the internal circumferential length of the belt is too short, tension (tensile force) exerted on the belt is so strong that the belt is likely to remain in a deformed shape that the belt had while no rotation was carried out. Accordingly, the first target temperature needs to be set at a high temperature. Further, when the tensile force exerted on the belt is further stronger, the belt cannot be appropriately restored to its normal shape from the deformed shape even under application of high temperature heat. This makes it impossible to prevent the rotation trouble. On the other hand, when the internal circumferential length of the belt is too long, tension exerted to the belt is so weak that pressure exerted in the rotation axis direction of the belt becomes uneven, with the result that the belt is winded. According to the above structure, by setting the internal circumferential length L5 such that 0.1 mm≦L5−L4≦2 mm is satisfied, it is possible to prevent the belt from having a deformed shape in which the belt stably remains, and from being winded when being rotated. This allows prevention of the rotation trouble of the belt.

The fixing apparatus of the present invention may further include a second heating section for heating the fixing member, the first and second heating sections heating according to electric power supplied from a electric power supplying section, wherein: the control section controls the supply of electric power from the electric power supplying section to the first and second heating sections such that the surface temperature of the belt reaches a second target temperature, which is a warm-up completion temperature of the belt, and then a surface temperature of the fixing member reaches a third target temperature, which is a warm-up completion temperature of the fixing member.

According to the above structure, the supply of electric power from the electric power supplying section to the first heating section is controlled such that: the surface temperature of the belt reaches the second target temperature that is the warm-up temperature of the belt, and then the surface temperature of the fixing member reaches the third target temperature that is the warm-up temperature of the fixing member. This makes it possible to quickly raise the surface temperature of the belt, thereby shortening time taken for the surface temperature of the belt to reach the first target temperature. This shortens warm-up time, i.e., time required for the fixing apparatus to be ready for the fixing process. Further, heat is conducted from the belt to the fixing member, so that the temperature of the surface of the fixing member is effectively raised.

Further, the fixing apparatus of the present invention may be arranged such that: the control section causes the electric power supplying section to supply electric power to the first heating section but not to supply electric power to the second heating section, until the surface temperature of the belt reaches the second target temperature, and after the surface temperature of the belt has reached the second target temperature, the control section causes the electric power supplying section to supply electric power to the first and second heating sections.

According to the above structure, until the surface temperature of the belt reaches the first target temperature, electric power is supplied to the first heating section but no electric power is supplied to the second heating section. This further shortens the time taken for the surface temperature of the belt to reach the first temperature target temperature, and accordingly shortens the warm-up time. Further, after the surface temperature of the belt has reached the second target temperature, electric power is supplied to the first and second heating sections, thus effectively raising the temperature of the surface of the fixing member.

Further, the fixing apparatus of the present invention may further include (i) a second heating section for heating the fixing member, and (ii) a third heating section for heating the pressure member, the first to third heating sections heating according to electric power supplied from an electric power supplying section, wherein: the control section controls the supply of electric power to the first to third heating sections such that the surface temperature of the belt reaches a second target temperature, which is a warm-up completion temperature of the belt, then a surface temperature of the fixing member reaches the a third target temperature, which is a warm-up completion temperature of the fixing member, and then a surface temperature of the pressure member reaches a fourth target temperature, which is a warm-up completion temperature of the pressure member.

According to the above structure, the supply of electric power from the electric power supplying section to the first heating section is controlled such that: the surface temperature of the belt reaches the second target temperature that is the warm-up temperature of the belt, then the surface temperature of the fixing member reaches the third target temperature that is the warm-up temperature of the fixing member, and then the surface temperature of the pressure member reaches the fourth target temperature that is the warm-up temperature of the pressure member. This makes it possible to quickly raise the surface temperature of the belt, thereby shortening time taken for the surface temperature of the belt to reach the first target temperature. This shortens the warm-up time, i.e., the time required for the fixing apparatus to be ready for the fixing process. Further, heat is conducted from the belt to the fixing member and is conducted from fixing member to the pressure member, so that the respective temperatures of the surfaces of the fixing member and the pressure member are effectively raised.

Further, the fixing apparatus of the present invention may be arranged such that: the control section causes the electric power supplying section to supply electric power to the first heating section but not to supply electric power to the second and third heating sections, until the surface temperature of the belt reaches the second target temperature, after the surface temperature of the belt has reached the second target temperature, the control section causes the electric power supplying section to supply electric power to the first and second heating sections but not to supply electric power to the third heating section, until the surface temperature of the fixing member reaches the third target temperature, and after the surface temperature of the fixing member has reached the third target temperature, the control section causes the electric power supplying section to supply electric power to the first to third heating sections.

According to the above structure, the control section causes electric power to be supplied to the first heating section but not to be supplied to the second and third heating sections, until the surface temperature of the belt reaches the second target temperature. When the surface temperature of the belt has reached the second target temperature, the control section causes electric power to be supplied to the first and second heating sections but not to be supplied to the third heating section. When the surface temperature of the fixing member has reached the third target temperature, the control section causes electric power to be supplied to the first to third heating sections. This shortens time taken for the surface temperature of the belt to reach the first target temperature, thereby further shortening the warm-up time. Further, the fixing member and the pressure member can be heated effectively.

Further, the fixing apparatus of the present invention may be arranged such that: the control section causes the first heating section to stop heating the belt, in cases where the temperature detected by the first temperature detecting section does not decrease within a predetermined time from the start of the rotation of the fixing member.

When the belt is rotated normally, an amount of heat conducted from the belt to the fixing member is large just after the start of rotation of the fixing member, so that the surface temperature of the belt is decreased. However, when the rotation trouble of the belt occurs, heat is not conducted appropriately from the belt to the fixing member, so that the surface temperature of the belt keeps on rising. In this case, even if temperature control is carried out when the surface temperature of the belt reaches the warm-up completion temperature, overshoot occurs, with the result that the belt has a temperature higher than the set temperature. An external heating device is normally designed to have a small heat capacity such that its temperature is raised quickly, so that the warm-up completion temperature is usually set at a high temperature such that heat is effectively conducted to the fixing member. Accordingly, once the rotation trouble of the belt occurs, excessive temperature rise occurs due to overshoot with ease.

However, according to the above structure, the control section judges whether or not the surface temperature of the belt detected by the first temperature detecting section never decreases but keeps on increasing within the predetermined time from the start of the rotation of the fixing member. In cases where the temperature keeps on increasing, the control section judges that the rotation trouble is currently occurring, and causes the first heating section to stop the heating. This allows prevention of excessive temperature rise in the external heating device.

An image forming apparatus of the present invention includes any one of the aforementioned fixing apparatuses. Therefore, it is possible to prevent the rotation trouble of the belt provided in the external heating device of the fixing apparatus.

Note that the control section of the fixing apparatus may be realized by a computer. In this case, the present invention encompasses (i) a control program for causing the computer to function as the control section, and (ii) a computer-readable recording medium storing the control program.

Further, the present invention is applicable to an electrophotographic image forming apparatus such as a printer, a copying machine, a facsimile, an MFP (Multi Function Printer).

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A fixing apparatus, comprising a fixing member; a pressure member; an external heating device, in which a belt set around a plurality of supporting rollers in contact with a peripheral surface of the fixing member is heated by a first heating section so as to heat the fixing member and the belt is rotated according to rotation of the fixing member; the fixing member and the pressure member sandwiching and transporting a recording material, so that an unfixed image formed on the recording material is fixed onto the recording material by heating from the fixing member, said fixing apparatus, further comprising:

a first temperature detecting section for detecting a surface temperature of the belt;

a rotation driving section for driving to rotate the fixing member; and a control section for causing the first heating section to heat the belt for start of rotation of the fixing member, and causing the rotation driving section to rotate the fixing member when the belt reaches a first target temperature at which the belt is softened, wherein:

$0.1\ \text{mm} \leqq L5 - L4 \leqq 2\ \text{mm}$ is satisfied, where L4 represents a minimal internal circumferential length that the belt requires in theory so as to be set around the supporting rollers, and L5 represents an internal circumferential length that the belt actually has when the belt is set around the supporting rollers.

2. A fixing apparatus, comprising a fixing member; a pressure member; an external heating device, in which a belt set around a plurality of supporting rollers in contact with a peripheral surface of the fixing member is heated by a first heating section so as to heat the fixing member and the belt is rotated according to rotation of the fixing member; the fixing member and the pressure member sandwiching and transporting a recording material, so that an unfixed image formed on the recording material is fixed onto the recording material by heating from the fixing member, said fixing apparatus, further comprising:

a first temperature detecting section for detecting a surface temperature of the belt;

a rotation driving section for driving to rotate the fixing member;

a control section for causing the first heating section to heat the belt for start of rotation of the fixing member, and causing the rotation driving section to rotate the fixing member when the belt reaches a first target temperature at which the belt is softened; and a second heating section for heating the fixing member, the first and second heating sections heating according to electric power supplied from an electric power supplying section, wherein:

the control section controls the supply of electric power from the electric power supplying section to the first and second heating sections such that the surface temperature of the belt reaches a second target temperature, which is a warm-up completion temperature of the belt, and then a surface temperature of the fixing member reaches a third target temperature, which is a warm-up completion temperature of the fixing member.

3. The fixing apparatus as set forth in claim 2, wherein:

the control section causes the electric power supplying section to supply electric power to the first heating section but not to supply electric power to the second heating section, until the surface temperature of the belt reaches the second target temperature, and after the surface temperature of the belt has reached the second target temperature, the control section causes the electric power supplying section to supply electric power to the first and second heating sections.

4. A fixing apparatus, comprising a fixing member; a pressure member; an external heating device, in which a belt set around a plurality of supporting rollers in contact with a peripheral surface of the fixing member is heated by a first heating section so as to heat the fixing member and the belt is rotated according to rotation of the fixing member; the fixing member and the pressure member sandwiching and transporting a recording material, so that an unfixed image formed on the recording material is fixed onto the recording material by heating from the fixing member, said fixing apparatus, further comprising:

a first temperature detecting section for detecting a surface temperature of the belt;

a rotation driving section for driving to rotate the fixing member;

a control section for causing the first heating section to heat the belt for start of rotation of the fixing member, and causing the rotation driving section to rotate the fixing member when the belt reaches a first target temperature at which the belt is softened; and (i) a second heating section for heating the fixing member, and (ii) a third heating section for heating the pressure member, the first to third heating sections heating according to electric power supplied from an electric power supplying section, wherein:

the control section controls the supply of electric power to the first to third heating sections such that the surface temperature of the belt reaches a second target temperature, which is a warm-up completion temperature of the belt, then a surface temperature of the fixing member reaches the a third target temperature, which is a warm-up completion temperature of the fixing member, and then a surface temperature of the pressure member reaches a fourth target temperature, which is a warm-up completion temperature of the pressure member.

5. The fixing apparatus as set forth in claim 4, wherein:

the control section causes the electric power supplying section to supply electric power to the first heating section but not to supply electric power to the second and third heating sections, until the surface temperature of the belt reaches the second target temperature, after the surface temperature of the belt has reached the second target temperature, the control section causes the electric power supplying section to supply electric power to the first and second heating sections but not to supply electric power to the third heating section, until the surface temperature of the fixing member reaches the third target temperature, and after the surface temperature of the fixing member has reached the third target temperature, the control section causes the electric power supplying section to supply electric power to the first to third heating sections.

6. An image forming apparatus, comprising: a fixing apparatus, including a fixing member; a pressure member; an external heating device, in which a belt set around a plurality of supporting rollers in contact with a peripheral surface of the fixing member is heated by a first heating section so as to heat the fixing member and the belt is rotated according to rotation of the fixing member; the fixing member and the pressure member sandwiching and transporting a recording material, so that an unfixed image formed on the recording material is fixed onto the recording material by heating from the fixing member, said fixing apparatus, further including:

a first temperature detecting section for detecting a surface temperature of the belt;

a rotation driving section for driving to rotate the fixing member; and a control section for causing the first heating section to heat the belt for start of rotation of the fixing member, and causing the rotation driving section to rotate the fixing member when the belt reaches a first target temperature at which the belt is softened, wherein $0.1\ \text{mm} \leqq L5 - L4 \leqq 2\ \text{mm}$ is satisfied, where L4 represents a minimal internal circumferential length that the belt requires in theory so as to be set around the supporting rollers, and L5 represents an internal circumferential length that the belt actually has when the belt is set around the supporting rollers.

* * * * *